US010046373B2

(12) United States Patent
Fujii et al.

(10) Patent No.: US 10,046,373 B2
(45) Date of Patent: Aug. 14, 2018

(54) TITANIUM CAST PRODUCT FOR HOT ROLLING AND METHOD FOR MANUFACTURING SAME

(71) Applicant: NIPPON STEEL & SUMITOMO METAL CORPORATION, Tokyo (JP)

(72) Inventors: Hideki Fujii, Tokyo (JP); Tomonori Kunieda, Tokyo (JP); Yoshitsugu Tatsuzawa, Tokyo (JP); Kenichi Mori, Tokyo (JP); Kazuhiro Takahashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 520 days.

(21) Appl. No.: 14/781,498

(22) PCT Filed: Apr. 1, 2014

(86) PCT No.: PCT/JP2014/059663

§ 371 (c)(1),
(2) Date: Sep. 30, 2015

(87) PCT Pub. No.: WO2014/163089

PCT Pub. Date: Oct. 9, 2014

(65) Prior Publication Data

US 2016/0038983 A1 Feb. 11, 2016

(30) Foreign Application Priority Data

Apr. 1, 2013 (JP) ..... 2013-075886

(51) Int. Cl.

| | |
|---|---|
| ***C22F 1/18*** | (2006.01) |
| ***B21B 1/22*** | (2006.01) |
| ***C22C 14/00*** | (2006.01) |

(52) U.S. Cl.
CPC ..... *B21B 1/22* (2013.01); *C22C 14/00* (2013.01); *C22F 1/183* (2013.01); *B21B 2001/225* (2013.01)

(58) Field of Classification Search
CPC ..... C22C 14/00; C22F 1/183
See application file for complete search history.

(56) References Cited

U.S. PATENT DOCUMENTS

| | | | |
|---|---|---|---|
| 5,125,986 | A | 6/1992 | Kimura et al. |
| 2011/0318597 | A1 | 12/2011 | Takahashi et al. |

FOREIGN PATENT DOCUMENTS

| | | | |
|---|---|---|---|
| CN | 1053643 | A | 8/1991 |
| EP | 0 434 069 | A1 | 6/1991 |

(Continued)

OTHER PUBLICATIONS

Chinese Office Action and Search Report, dated Oct. 10, 2016, for corresponding Chinese Application No. 201480020231.7, with an English translation of the Office Action.

(Continued)

*Primary Examiner* — Jessee Roe
(74) *Attorney, Agent, or Firm* — Birch, Stewart, Kolasch & Birch, LLP

(57) ABSTRACT

There is provided a titanium cast product for hot rolling composed of commercially pure titanium, the titanium cast product including: a microstructural refinement layer having acicular microstructure on an outermost layer of a surface layer to be rolled; and an inside microstructural refinement layer having acicular microstructure provided in an inside of the microstructural refinement layer. Cast solidification microstructure is present more inward than the inside microstructural refinement layer. The microstructural refinement layer has finer microstructure than the inside microstructural refinement layer. The microstructural refinement layer is present in a range of a depth of 1 mm or more and less than (Continued)

6 mm from the surface. The inside microstructural refinement layer is present in an inside of the microstructural refinement layer in a range of a depth of 3 mm or more and 20 mm or less from the surface.

20 Claims, 5 Drawing Sheets

(56) References Cited

FOREIGN PATENT DOCUMENTS

| | | | |
|---|---|---|---|
| JP | 8-60317 | A | 3/1996 |
| JP | 9-314278 | A | 12/1997 |
| JP | 2007-84855 | A | 12/2007 |
| JP | 2007-332420 | A | 12/2007 |
| WO | WO 2010/090352 | A1 | 8/2010 |

OTHER PUBLICATIONS

Extended European Search Report, dated Oct. 27, 2016, for corresponding European Application No. 14779552.0.
Chinese Office Action and Search Report dated Jun. 6, 2017, for corresponding Chinese Application No. 201480020231.7, with partial English translation of the Chinese Office Action.
European Office Action, dated Oct. 11, 2017, for corresponding European Application No. 14779552.0.
International Search Report, issued in PCT/JP2014/059663, dated Jun. 24, 2014.
Written Opinion of the International Searching Authority, issued in PCT/JP2014/059663, dated Jun. 24, 2014.

[Fig. 1]
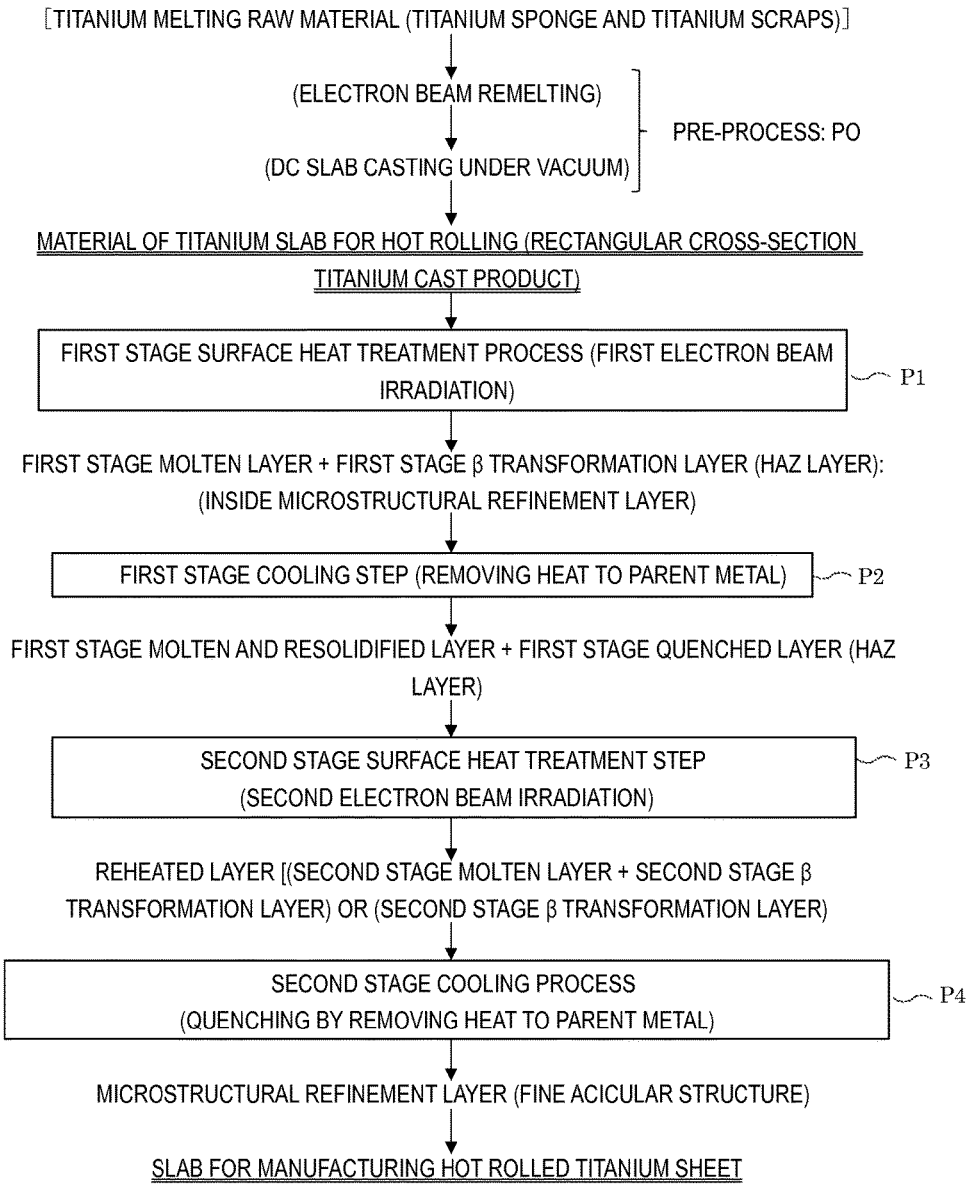

[Fig. 2]
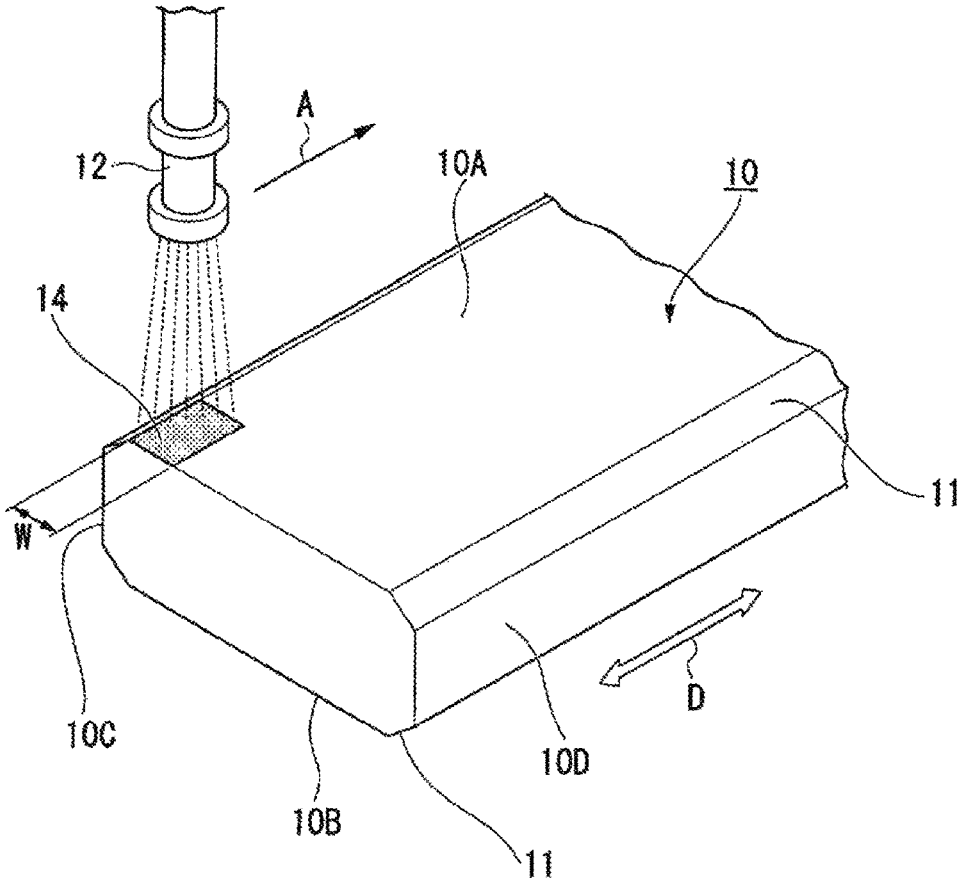

[Fig. 3]
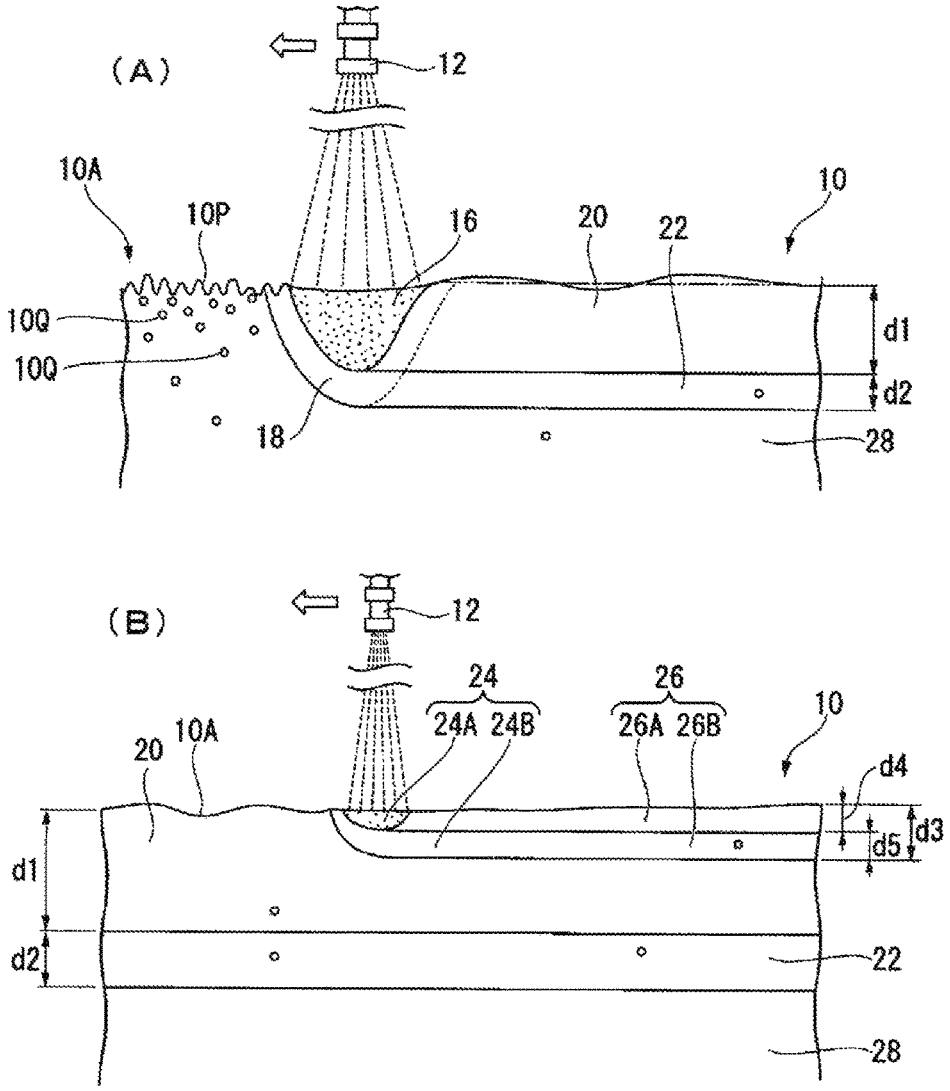

[Fig. 4]
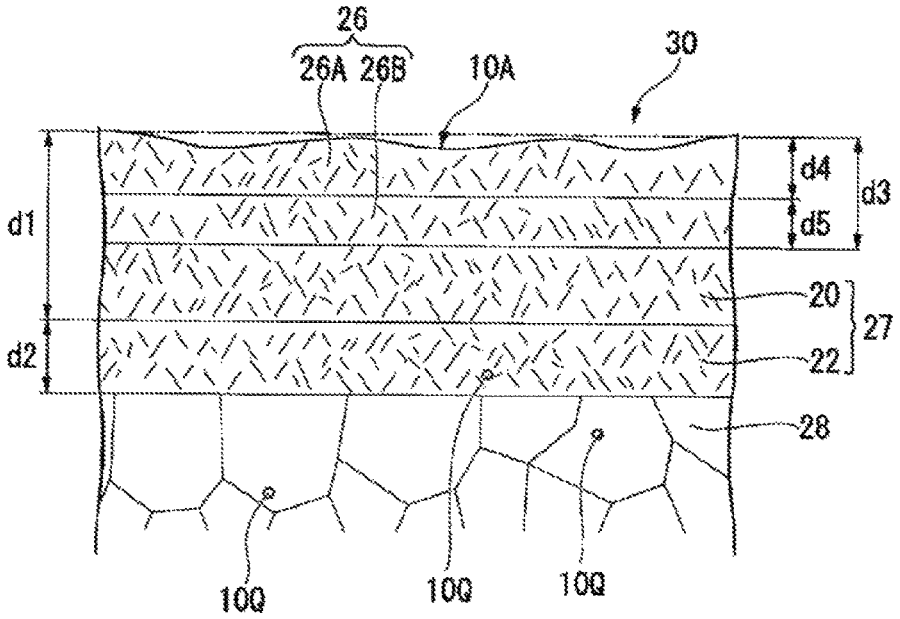
[Fig. 5]
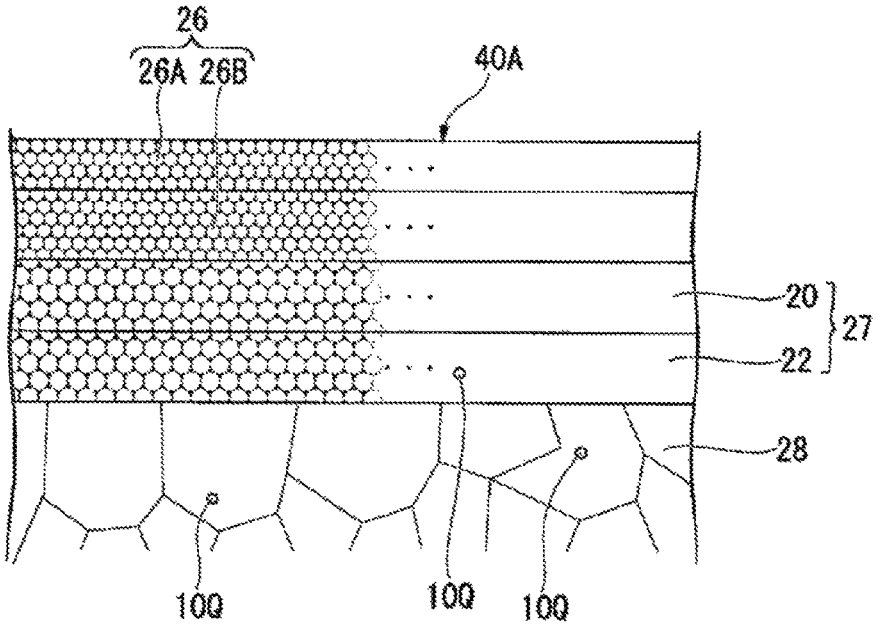

[Fig. 6]
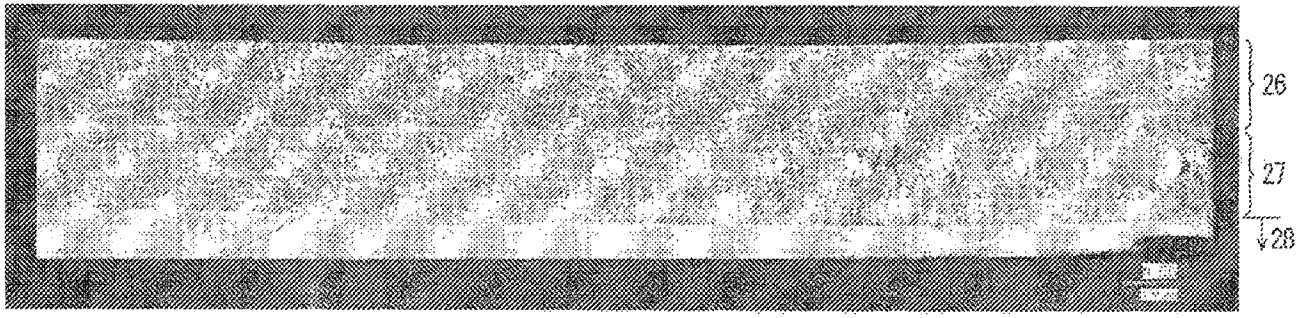

TITANIUM CAST PRODUCT FOR HOT ROLLING AND METHOD FOR MANUFACTURING SAME

TECHNICAL FIELD

The present invention relates to titanium cast products for hot rolling composed of commercially pure titanium, and methods for manufacturing the same, specifically to a titanium cast product for hot rolling, which bears a hot rolled sheet excellent in a surface quality, and a method for manufacturing the same. This application is based upon and claims the benefit of priority from the prior Japan Patent Application No. 2013-075886, filed on Apr. 1, 2013 with the Japan Patent Office, the contents of which are incorporated herein by reference.

BACKGROUND ART

In general, commercially pure titanium is prepared usually in the form of a large cast product by using titanium sponge obtained by a Kroll process and titanium scraps as melting raw materials and melting them by vacuum arc remelting (VAR) and electron beam remelting (EBR). In this connection, the form of the cast product is limited to a cylindrical cast product in the case of VAR. On the other hand, the materials can be casted into a rectangular cross-section cast product, that is, a slab in the case of EBR.

Further, when such the large cast product as described above is used as a raw material to manufacture titanium materials such as titanium sheets and the like, the large cast product is subjected, if necessary, to cutting treatment of a surface and then to slab rolling or forging at a hot temperature to deform the large ingot into a slab having a form and a size which are suited to subsequent hot rolling. A hot working process carried out by the above slab rolling or forging is referred to as a breakdown process in this application. Further, usually, the slab is subjected to cutting treatment for removing a surface thereof by about several mm by cutting work in order to remove an oxide layer and an oxygen-enriched layer which are formed on the surface of the slab after the breakdown process, and then the slab is subjected to hot rolling.

However, the above conventional method requires a great deal of time and costs for the breakdown process carried out by slab rolling or forging for deforming the large cast product into a form and a size which are suited to hot rolling, and this has largely hindered an improvement in a productivity and a reduction in a cost in manufacturing titanium sheets.

On the other hand, in recent years, a technique for manufacturing a relatively thin slab-shaped cast product, that is, a titanium cast product having a form and a size which make it possible to subject the cast product to hot rolling as it is, by a DC slab casting method (direct casting method) is being established as a method for casting a slab-shaped cast product instead of casting such the large ingot as described above. According to the DC slab casting method, molten titanium obtained by melting titanium in a hearth by an electron beam and the like is continuously injected into a water-cooled copper mold maintained to be a vacuum atmosphere, and a part of the molten titanium solidified in the water-cooled copper mold is continuously pulled out from a lower end side of the mold to obtain a slab-shaped cast product having a prescribed length.

Applying the DC slab casting method carried out by the above EBR and the like under vacuum makes it possible to omit the breakdown process which has conventionally been required, which results in making it possible to improve a productivity in manufacturing a titanium sheet and reduce a manufacturing cost thereof.

Further, there is the problem that even when a slab (omitting the breakdown process) obtained by applying the DC slab casting method carried out by the EBR and the like under vacuum as described above is subjected to hot rolling, the surface property of a hot rolled sheet after hot rolling is not necessarily improved. That is, there is the problem that many small and large overlapping flaws having a length of several mm to about 10 mm are formed on the surface of the hot rolled sheet. Such many overlapping flaws formed on the surface shall be referred to as surface flaws in this application. Such the surface flaws formed on the hot rolled sheet are considered to originate in coarse cast microstructure of a cast slab. That is, a slab manufactured without passing through the breakdown process in which hot working is carried out has cast microstructure composed of coarse crystal grains as cast, and even if the surface thereof is subjected to cutting work to make undulations on the surface smaller, the coarse microstructure is present in the surface layer after cutting. It is considered that the surface flaws are formed on the hot rolled sheet due to the cast micro structure of such the coarse cast microstructure in the surface layer.

In this connection, a specific factor in which surface flaws are formed on a hot rolled sheet due to coarse cast microstructure is considered to be attributable to that relatively large dents are formed in a boundary part between a mother phase and a twin crystal because of a large misorientation between the mother phase and the twin crystal and a coarse hot twin crystal formed in the beginning of hot rolling and metal is overlapped on the above dents to turn into surface flaws as subsequent hot rolling proceeds.

On the other hand, there has already been proposed some methods in which a surface layer of a titanium slab for hot rolling which is obtained without passing through the breakdown process is subjected to reforming treatment before hot rolling in order to prevent surface flaws from being formed on a surface of a hot rolled sheet after hot rolling.

For example, in Patent Literature 1, it is proposed that a surface of a titanium slab for hot rolling is struck (subjected to plastic deformation) at a room temperature by a steel tool with a tip curvature radius of 3 to 30 mm or a steel ball having a radius of 3 to 30 mm, which provides the slab with dimples having an average height of 0.2 to 1.5 mm and an average length of 3 to 15 mm in a contour curve element of a undulation. In the method proposed above, the surface layer of the titanium slab is provided with prescribed plastic strain at the room temperature by the steel-made tool or the steel ball each described above to thereby recrystallize the surface layer in subsequent heating prior to hot rolling and form fine microstructure, whereby dents can be prevented from being formed due to such the coarse microstructure as described above. Accordingly, even when the breakdown process is omitted, surface flaws of a hot rolled sheet can be reduced.

In Patent Literature 2, there is proposed a method in which a surface of a titanium slab for hot rolling, especially a surface of a side which is a surface to be rolled in hot rolling is provided with high energy by high frequency induction heating, arc heating, plasma heating, electron beam heating, laser heating and the like to melt only the surface layer by a depth of 1 mm or more and in which the surface is immediately quenched and solidified again. In the case of the method proposed above, titanium has naturally a melting point which is higher a β transformation point, and therefore as the surface is molten, a heat affected zone (HAZ) layer of a lower side (parent metal side) than the molten layer on the surface is heated as well to the β transformation point or higher and subjected to β transformation. In the method proposed above, the surface layer of the titanium slab for hot rolling is molten, whereby the surface is smoothed; further, the molten layer is then quenched by removing heat to the parent metal side and solidified; and at the same time, the HAZ layer (β phase) at a lower side is quenched, whereby the molten layer and the HAZ layer are turned into fine transformation microstructure (usually fine acicular microstructure). Then, the surface layer which has been refined in the manner described above is recrystallized in the subsequent reheating prior to hot rolling and turned into granular microstructure (equiaxed grain microstructure) having a fine and random orientation. Accordingly, dents attributable to the coarse microstructure can be prevented from being formed, and the surface flaws on the hot rolled sheet after hot rolling can be overcome as well.

PRIOR ART LITERATURE(S)

Patent Literature(s)

[Patent Literature 1] WO 2010/090352
[Patent Literature 2] JP 2007-332420A

SUMMARY OF THE INVENTION

Problem(s) to Be Solved by the Invention

It has been confirmed by experiments carried out by the present inventors and the like that according to the surface layer reforming treatment method in which a surface layer of a titanium slab for hot rolling is provided with plastic deformation in a room temperature as shown in Patent Literature 1 and the surface layer reforming treatment method in which the surface of a titanium slab for hot rolling is provided with high energy to melt only the surface layer and in which the surface layer is quenched and solidified again as shown in Patent Literature 2, even the surface layer of the titanium slab for hot rolling which is manufactured without passing through the breakdown process can effectively be reformed depending on the surface situations thereof to prevent surface flaws from being formed on the hot rolled sheet. That is, the surface layer of a cast product as cast by DC slab casting under vacuum usually has marked undulations and is defective to a large extent as already described above. It has been confirmed, however, that the surface layer of the above slab is removed by a depth of several mm by cutting work and then subjected to the surface layer reforming treatment as shown in Patent Literature 1 or Patent Literature 2, whereby surface flaws on the hot rolled sheet after subsequent hot rolling can be prevented from being formed.

However, large amounts of labor and time are required for surface cutting work before the surface reforming treatment described above, and the yield thereof is reduced to a large extent. Accordingly, if it becomes possible to suppress formation of surface flaws on the hot rolled sheet by the surface reforming treatment even when omitting the above surface cutting work, a titanium sheet having an excellent surface property can be manufactured at a high productivity and a low cost. However, it has become clear that when an as cast product in which a black mill scale skin is present on a surface is subjected to surface reforming treatment without subjecting the surface to the cutting work described above before the surface reforming treatment, it is difficult to surely and stably suppress formation of surface flaws on the surface of the hot rolled sheet.

Accordingly, the present invention focuses on providing a titanium cast product for hot rolling and a method for manufacturing the same, the method not only omits a breakdown process but also does not require cutting work before surface reforming treatment and makes it possible to surely prevent surface flaws from being formed on the surface of the hot rolled sheet after subsequent hot rolling, so that a titanium hot rolled sheet can be improved in manufacturing and reduced in a cost.

Means for Solving the Problem(s)

In order to solve the above problems, the present inventors have intensively repeated experiments and investigations on the surface reforming technique shown in Patent Literature 2 described above to result in obtaining the following knowledge.

That is, a surface of a cast product is heated by heating means having a high energy density such as an electron beam to melt only a surface layer, and then the cast product is cooled usually by removing heat to a parent metal side. In this case, the smaller the thickness of the molten layer is, the smaller the heat input per unit area of a cast product surface (hereinafter, the unit area is 1 $cm^2$ in terms of the heat input) is, and therefore the cooling rate immediately after heating is increased, so that the surface layer (molten and resolidified layer) solidified by cooling is turned into finer microstructure. The microstructure of the surface layer heated for subsequent hot rolling is more refined as well and results in making it possible to surely suppress relatively large dents formed in the beginning of hot rolling and surface flaws formed on the hot rolled sheet.

However, when a melting depth is small, defects (originating in casting) such as voids and wrinkles which are present in a position of a certain degree of a depth from the surface do not disappear in some cases. That is, it has been confirmed by experiments that the melting depth has to be controlled to several mm or less in order to sufficiently refine the microstructure of the surface layer by resolidification after remelting. However, in many cases, voids originating in casting are present in a deeper position than the above level, that is, a position of a depth of 5 to 8 mm that exceeds the several mm from the surface. Accordingly, when the surface layer is molten only by a depth of several mm, voids present in a relatively deeper position do not disappear and therefore it is acknowledged that cracks are formed with the above voids as starting points in hot rolling and that relatively large concave parts are produced on the surface to generate surface flaws.

It is considered that the problem described above can be solved by increasing a melting depth in heating the surface of the cast product by heating means having a high energy density such as an electron beam to melt the surface layer. In the above case, however, the heat input per unit area of a cast product surface is increased contrary to the case described above, and the cooling rate in removing heat to a parent metal side immediately after heating is decreased, so that the microstructure of the surface layer (molten and resolidified layer) solidified by cooling is not sufficiently refined. The microstructure of the surface layer heated for subsequent hot rolling is not sufficiently refined as well and therefore relatively large dents formed in the beginning of hot rolling and surface flaws formed on a hot rolled sheet are not sufficiently reduced.

Intensive experiments and investigations repeated by the present inventors based on the above new knowledge have resulted in finding that relatively large dents formed in the beginning of hot rolling and surface flaws formed on a hot rolled sheet can surely be suppressed by further improving the surface reforming technology shown in Patent Literature 2 and especially resulted in finding that relatively large dents formed in the beginning of hot rolling and surface flaws formed on a hot rolled sheet can surely be suppressed as well in a cast surface of the as cast slab which is not subjected in advance to cutting work.

That is, a surface layer of a cast product which is a material of a slab for hot rolling is molten by irradiation with an electron beam or the like and resolidified, and then the surface of the molten and resolidified layer is irradiated again with an electron beam or the like to heat a surface region (region having a shallower depth than a depth of the molten and resolidified layer) in the molten and resolidified layer to a temperature of a β transformation point or higher to quench and solidify the surface area. It has been found that since such heating is performed twice on the surface layer by irradiation with an electron beam or the like, it is possible to surely prevent relatively large dents formed in the beginning of hot rolling and surface flaws formed on a hot rolled sheet and in addition to the above, formation of surface flaws formed on a hot rolled sheet after subsequent hot rolling can surely be suppressed as well in a cast surface of the as cast slab which is not subjected to cutting work in advance. Thus, the present invention has been made.

According to the present invention, there is provided a titanium cast product for hot rolling composed of commercially pure titanium, the titanium cast product including: a microstructural refinement layer having acicular microstructure on an surface; and an inside microstructural refinement layer having acicular microstructure provided in an inside of the microstructural refinement layer. Cast solidification microstructure is present more inward than the inside microstructural refinement layer. The microstructural refinement layer has finer microstructure than the inside microstructural refinement layer. The microstructural refinement layer is present in a range of a depth of 1 mm or more and less than 6 mm from the surface. The inside microstructural refinement layer is present in an inside of the microstructural refinement layer in a range of a depth of 3 mm or more and 20 mm or less from the surface.

In such the titanium cast product for hot rolling according to the present invention as described above, a microstructural refinement layer present on an outermost surface is turned, as explained later in the manufacturing method, into an equiaxed fine granular microstructure in a random orientation in a state in which the cast product is subjected to heat treatment prior to hot rolling or equivalent one and recrystallized. In this connection, the heat treatment prior to hot rolling or equivalent one shall mean heat treatment at 820° C. for 240 minutes in the present invention. That is, in general, a titanium slab is hot-rolled usually by heating at approximately 720 to 920° C. for approximately 60 to 420 minutes. Then, a hot rolling heating condition which is in the middle of the above conditions is adopted in the present invention, and a grain diameter at a time of subjecting the cast product to heat treatment prior to hot rolling or equivalent one at 820° C. for 240 minutes is prescribed as an index of refinement of the microstructure refinement layer.

According to the present invention, there is provided a method for manufacturing a titanium cast product for hot rolling, the method including: a first stage surface heat treatment process of heating a surface of a cast product material composed of commercially pure titanium to be rolled in hot rolling to heat a region of a depth of 6 mm or more and 20 mm or less from the surface to a β transformation point or higher and to melt a range of a depth of 3 mm or more and 10 mm from the surface, and a first stage cooling process of cooling the cast product material to temperature lower than the β transformation point after the first stage surface heat treatment process; and a second stage surface heat treatment process of reheating the surface subjected to the first stage surface heat treatment process and the first stage cooling process to heat a region of a depth of 1 mm or more and less than 6 mm from the surface to the β transformation point or higher, and a second stage cooling process of cooling the cast product material to temperature lower than the β transformation point after the second stage surface heat treatment process.

In this connection, the β transformation point is temperature at which or higher the β phase is a stable phase and at which or lower the α phase is substantially a stable phase. The β transformation point is 880 to 920° C. in commercially pure titanium.

According to the present invention, marked undulations present on a cast surface after casting are removed and smoothed by melting, and at the same time, defects such as internal voids originating in casting are eliminated. Further, coarse cast microstructure disappears as well. In addition, the surface is turned into a microstructural refinement layer by reheating and quenching. Accordingly, in subjecting the titanium cast product for hot rolling according to the present invention to hot rolling, surface flaws due to wrinkles and internal voids originating in casting can be prevented in advance from being formed, and at the same time, relatively large concave parts in the beginning of hot rolling originating in insufficient microstructure refinement and surface flaws on the hot rolled sheet can surely be prevented as well in advance from being formed.

That is, an inside microstructural refinement layer which is molten and heated to a β transformation point or higher in melting and resolidifying at a first stage has a sufficient thickness from 6 mm or more to 20 mm or less from the surface, and the inside microstructural refinement layer which is molten and resolidified up to a deeper position than a cutting stock (about several mm) in a conventional method. Accordingly, voids (voids present in a position of a depth exceeding a usual cutting stock) present in a deeper position than a position of several mm from the surface are sufficiently removed, and at the same time, marked undulations on the surface are eliminated as well.

On the other hand, a reheated and quenched microstructural refinement layer at a surface side of a second stage is a thin layer present in a position of 1 mm or more and less than 6 mm from the surface, and therefore the microstructural refinement layer is turned into a layer having sufficiently fine microstructure by a high-speed quenching effect provided by removing heat to the parent metal after reheating. Accordingly, relatively large concave parts in the beginning of hot rolling originating in insufficient microstructural refinement and surface flaws on the hot rolled sheet can surely be prevented as well from being formed.

The respective actions described above can be obtained as well in a cast product staying in a state in which the cast product does not pass through a breakdown process carried out by slab rolling, forging or the like in hot working after casting, and such actions can be obtained as well in a cast product with so-called black mill scale skins as cast whose surface is not subjected in advance to cutting work.

The titanium cast product for hot rolling according to the present invention may include at least one kind of α-phase stabilizing elements and neutral elements in an amount of 0% or more and less than 2.0% in terms of total mass % in a range of a depth of 4 mm or less from the surface. The titanium cast product for hot rolling according to the present invention may include at least one kind of β-phase stabilizing elements in an amount of 1.5% or less in terms of total mass % in a range of a depth of 4 mm or less from the surface. The titanium cast product for hot rolling according to the present invention may include, in a range of a depth of 4 mm or less from the surface, at least one kind of α-phase stabilizing elements and neutral elements in an amount of 0% or more and less than 2.0% in terms of total mass %, and at least one kind of β-phase stabilizing elements in an amount of 1.5% or less in terms of total mass %.

With regard to the titanium cast product for hot rolling according to the present invention, the number of crystal grains having a crystal grain diameter of 3 mm or more is preferably 5 or less per $m^2$ of the surface in a state at room temperature after heat treatment at 820° C. for 240 minutes.

With regard to the method for manufacturing a titanium cast product for hot rolling according to the present invention, a heat input per unit area (1 $cm^2$) in the second stage surface heat treatment process may be set to be lower than a heat input per unit area in the first stage surface heat treatment process.

In this respect, the heat input in the second stage surface heating treatment process described above is more reduced than the heat input in the first stage surface heating treatment process since a thickness of the molten layer or the HAZ layer formed in heating the second stage has to be smaller than a thickness of the layer formed in the first stage.

With regard to the method for manufacturing a titanium cast product for hot rolling according to the present invention, an electron beam may be radiated while continuously moving an electron beam radiation gun in a direction parallel to the surface of the cast product material in the respective processes of the first stage surface heat treatment process and the second stage surface heat treatment process.

The first stage cooling process and the second stage cooling process may be carried out by removing heat to a parent metal side of the cast product material. In this case, the cast product material is allowed to pass through the β transformation point at a cooling rate of 60° C./minute or more in the second stage cooling process.

In this regard, if the cooling rate at the second stage cooling process is less than 60° C./minute, the crystal grains are likely to be insufficiently refined.

The second stage surface heat treatment process and the second stage cooling process can be carried out plural times.

The surface may be molten together with a material containing at least one kind of α-phase stabilizing elements and neutral elements in the second stage surface heat treatment process. The surface may be molten together with a material containing at least one kind of β-phase stabilizing elements in the second stage surface heat treatment process. The surface may be molten together with a material containing at least one kind of α-phase stabilizing elements and neutral elements and a material containing at least one kind of β-phase stabilizing elements in the second stage surface heat treatment process.

In the method for manufacturing a titanium cast product for hot rolling according to the present invention, the surface may be molten in the second stage surface heat treatment process. In this case, the surface may be molten together with a material containing at least one kind of α-phase stabilizing elements and neutral elements in the second stage surface heat treatment process. The surface may be molten together with a material containing at least one kind of β-phase stabilizing elements in the second stage surface heat treatment process. The surface may be molten together with a material containing at least one kind of α-phase stabilizing elements and neutral elements and a material containing at least one kind of β-phase stabilizing elements in the second stage surface heat treatment process.

In the method for manufacturing the titanium cast product for hot rolling according to the present invention, the material for the cast product described above may be any of those prepared by casting a material by the DC slab casting method, those prepared by casting a molten metal obtained by the melting method with an electron beam and the like by the DC slab casting method, and those having a as cast surface. The above the rectangular cross-section cast products are obtained without passing through the breakdown process including slab rolling or forging. The melting method for the same shall not specifically be restricted, and an EBR method, a plasma arc melting method and the like can be applied. In the EBR method, since melting is carried out in high vacuum, an inside of voids remaining in the vicinity of a slab surface after melting stays in vacuum, and therefore there is the advantage that the voids are easy to be pressed in hot rolling and turned into harmlessness.

Effect(s) of the Invention

The titanium cast product for hot rolling according to the present invention has a flat and smooth surface and a few minute voids in an inside directly under the surface and is provided with a markedly fine microstructure in an outermost surface layer. Accordingly, when the titanium cast product is subjected to hot rolling, the cast product can surely and stably be prevented from formation of relatively large concave parts on the surface in the beginning of hot rolling and generation of surface flaws on the hot rolled sheet. The above effects can be obtained as well by using a cast product which does not pass through a breakdown process carried out by slab rolling or forging and which is not subjected to surface finishing by cutting work as a material for producing the titanium cast product for hot rolling. Accordingly, the breakdown process and the surface finishing by cutting work can be omitted, and the cost can be reduced more markedly than ever.

BRIEF DESCRIPTION OF THE DRAWING(S)

FIG. 1 is a schematic drawing showing a flow of an embodiment of the method for manufacturing the titanium cast product for hot rolling according to the present invention.

FIG. 2 is a schematic perspective drawing showing an outline of one example of a material (rectangular cross-section titanium cast product) used in an embodiment of the method for manufacturing the titanium cast product for hot rolling according to the present invention, and a state of irradiating the titanium cast product with an electron beam.

FIG. 3 is a schematic cross section showing, in stages, one example of a transition in the surface layer of the rectangular cross-section titanium cast product of the material in an embodiment of the method for manufacturing the titanium cast product for hot rolling according to the present invention.

FIG. 4 is a schematic drawing showing one example of a cross-sectional structure in the vicinity of the surface of the titanium cast product for hot rolling according to the present invention.

FIG. 5 is a schematic drawing showing one example of a cross-sectional structure in the vicinity of the surface of the titanium cast product staying in a state in which the titanium cast product for hot rolling according to the present invention is subjected to heat treatment prior to hot rolling or equivalent one.

FIG. 6 is a s cross-sectional observation photograph showing a microstructural refinement layer, an inside microstructural refinement layer and a casting solidification microstructure in a surface part of the titanium cast product for hot rolling according to the present invention.

MODE(S) FOR CARRYING OUT THE INVENTION

Hereinafter, referring to the appended drawings, embodiments of the present invention will be described in detail.

FIG. 1 schematically shows the respective processes P1 to P4 of the overall process in the method for manufacturing the titanium cast product for hot rolling according to an embodiment of the present invention. In FIG. 1, an example of a process for manufacturing the rectangular cross-section titanium cast product which is the material is also shown as a pre-process P0. Also, FIG. 2 shows an outline of a material (rectangular cross-section titanium cast product) used in the embodiment of the method for manufacturing the titanium cast product for hot rolling according to the present invention, and a state of irradiating the rectangular cross-section titanium cast product with an electron beam. Further, FIG. 3 shows, in stages, a transition in a cross-sectional state in the vicinity of the surface of the rectangular cross-section titanium cast product in the respective processes in an embodiment of the manufacturing method shown in FIG. 1.

[Pre-Process P0]

In manufacturing the titanium cast product for hot rolling according to the present invention, only a prescribed amount of a melting raw material for commercially pure titanium, for example, titanium sponge obtained by a Kroll process and titanium scraps are molten in a hearth by EBR as shown in FIG. 1 as a pre-process P0. The molten titanium thus obtained is teemed continuously into a water-cooled copper mold for casting a DC slab, that is, a water-cooled copper mold in which upper and lower parts are opened and in which a lateral cross section is rectangular (including a case in which chamfers are formed in corners). Further, the cast product solidified in the mold is continuously pulled out downward, whereby a rectangular cross-section (slab-shaped) titanium cast product having a thickness, a width and a length which are suited to hot rolling in a form and a dimension as cast is obtained. In this regard, the cast product which is provided with chamfers in corners shall also be referred to as a "rectangular cross-section cast product" in a wide sense. An atmosphere in performing melting in the hearth by heating with an electron beam and casting each described above is kept to vacuum.

In this application, the commercially pure titanium includes commercially pure titanium prescribed in JIS Class 1 to JIS Class 4, ASTM Grades 1 to 4, DIN 37025, DIN 37035, and DIN 37055 each corresponding to the JIS standards. That is, the commercially pure titanium referred to in the present invention can be composed of, in mass %, C: 0.1% or less, H: 0.015% or less, O: 0.4% or less, N: 0.07% or less, Fe: 0.5% or less, and the balance: Ti. Further, high corrosion resistant alloys (titanium materials prescribed in ASTM Grades 7, 11, 16, 26, 13, 30 and 33, or JIS standards corresponding to the ASTM Grades, or titanium materials obtained by adding other kinds of elements thereto in small amounts) called modified (improved) pure titanium which are obtained by adding slight amounts of platinum group elements to the commercially industrial pure titanium are also referred to as titanium included in the commercially pure titanium in the present invention.

In manufacturing the titanium cast product for hot rolling according to the present invention, a rectangular cross-section titanium cast product which is a material for the titanium cast product can be obtained basically by an optional melting method and an optional casting method. A rectangular cross-section titanium cast product obtained, as explained in the present embodiment, by melting a raw material such as titanium sponge, titanium scraps and the like by EBR under vacuum and casting the molten titanium under vacuum into a rectangular cross-section form or rectangular parallelepiped form (slab-shaped) having a long rectangular form in a cross section by the DC slab casting method can exert most effectively the effects of the present invention. The rectangular cross-section titanium cast product having a rectangular cross section of a form and a dimension which are suited to hot rolling can readily be obtained according to the DC slab casting method, and therefore the hot breakdown process including slab rolling and forging at a hot temperature can be omitted.

The dimension of the rectangular cross-section titanium cast product shall not specifically be restricted as long as the titanium cast product has a dimension which can be subjected to hot rolling as it is. When coil rolling is applied as the hot rolling to manufacture a hot rolled coil thin and medium plates having a plate thickness of about 3 mm to 8 mm, the dimension of the rectangular cross-section titanium cast product can be set to a thickness of about 150 mm to 280 mm, a length of about 3 m to 10 m, and a width of about 600 mm to 1580 mm.

Further, billets, blooms and the like which are subjected to hot rolling can exert the same effects as well by subjecting the parts corresponding to surfaces to be rolled to heat treatment and hot rolling in the manners of the present invention. The titanium cast product which is the raw material includes not only rectangular cross-section (slab-shaped) cast products but also billets and blooms.

The rectangular cross-section titanium cast product obtained by DC slab casting with EBR and the like in the manner described above is subjected as it is to, as shown in FIG. 1, a first stage surface heat treatment process P1, a first stage cooling process P2, a second stage surface heat treatment process P3 and a second stage cooling process P4 in this order. In this connection, subjecting the rectangular cross-section titanium cast product as it is to the respective P1 to P4 processes means subjecting the rectangular cross-section titanium cast product as a raw material as cast to the respective P1 to P4 processes without passing through a breakdown process carried out by hot working such as slab rolling and forging and a cutting process for surface finishing, as a material for producing a slab for manufacturing a hot rolled titanium sheet. Accordingly, the rectangular cross-section titanium cast product which is a material for the titanium cast product for hot rolling has not only the surface property of coarse undulations originating in casting, but also coarse cast microstructure, and many defects such as voids originating in casting are usually present in the parts of up to a depth of about 8 mm to 10 mm from the surface.

The respective P1 to P4 processes described below are carried out to at least two surfaces (that is, two wide surfaces) which are surfaces to be rolled in the hot rolling process (surfaces brought into contact with the hot rolling rolls) out of four surfaces excluding a front end surface (lower end surface corresponding to a cast starting surface) and a rear end surface (upper end surface corresponding to a cast finishing surface) in DC slab casting among the outer surfaces of the rectangular cross-section titanium cast product. In the case of the rectangular cross-section cast product having chamfers, the chamfer surfaces constitute a part of the two wide surfaces described above.

To be specific, in a rectangular cross-section titanium cast product 10 having chamfers 11 as shown in FIG. 2 for example, two wide surfaces 10A and 10B (surfaces containing chamfers 11) out of four surfaces 10A to 10D along a casting direction D (a direction of pulling out the cast product in DC slab casting) are surfaces to be rolled in hot rolling. Accordingly, at least the two wide surfaces 10A, 10B containing the chamfers 11 are subjected to the respective P1 to P4 processes.

When the two wide surfaces 10A and 10B described above are subjected to the respective P1 to P4 processes, the order of the respective surfaces and the respective processes includes the following two cases of A and B. In the present embodiment, explanations shall be given assuming that the case of B is applied for the sake of simplifying the explanations. Also when the melting treatment of the surface at the second stage is carried out plural times, the process of A or B may be carried out, or both processes of A and B may be carried out in a mixture.

Case A: among the two surfaces 10A and 10B, one surface 10A is subjected to the first stage surface heat treatment process P1 to the first stage cooling process P2, and then the other surface 10B is similarly subjected to the first stage surface heat treatment process P1 to the first stage cooling process P2. Thereafter, any one (for example, 10A) of the above surfaces is subjected to the second stage surface heat treatment process P3 to the second stage cooling process P4, and then the other surface (for example, 10B) is subjected to the second stage surface heat treatment process P3 to the second stage cooling process P4.

Case B: among the two surfaces 10A and 10B, one surface 10A is subjected to the first stage surface heat treatment process P1 to the first stage cooling process P2, and then subsequently the same surface 10A is subjected to the second stage surface heat treatment process P3 to the second stage cooling process P4. Thereafter, the other surface 10B is subjected to the first stage surface heat treatment process P1 to the first stage cooling process P2, and then subsequently the same surface 10B is subjected to the second stage surface heat treatment process P3 to the second stage cooling process P4.

Further, not only the two wide surfaces 10A and 10B (surfaces which are surfaces to be rolled in hot rolling) out of the four surfaces 10A to 10D along the casting direction D, but also two narrow surfaces 10C and 10D (surfaces which are edge sides in hot rolling) may be subjected as well to the respective processes P1 to P4. In the above case, the two narrow surfaces 10C and 10D at the edge sides may be subjected to the respective processes P1 to P4 after subjecting the two wide surfaces 10A and 10B which are surfaces to be hot rolled to the respective processes P1 to P4 is finished. Alternatively, in the case A described above, the two wide surfaces 10A and 10B which are the surfaces to be hot rolled may be subjected to the first stage surface heat treatment process P1 to the first stage cooling process P2, and then subsequently the two surfaces 10C and 10D at the edge sides may be similarly subjected to the first stage surface heat treatment process P1 to the first stage cooling process P2. Thereafter, the two wide surfaces 10A and 10B which are the surfaces to be hot rolled and the two surfaces 10C and 10D at the edge sides may be subjected to the second stage surface heat treatment process P3 to the second stage cooling process P4 in order. In the present embodiment, however, the respective processes P1 to P4 for the two surfaces 10C and 10D at the edge sides are omitted for the sake of simplifying the explanations.

The respective processes P1 to P4 are further explained below in detail.

[First Stage Surface Heat Treatment Process P1] to [First Stage Cooling Process P2]

As described above, the rectangular cross-section titanium cast product obtained by EBR and DC slab casting is subjected as it is to the first stage surface heat treatment process P1. The first stage surface heat treatment process P1 is, as shown in FIG. 2, a process in which only the surface layers of the two wide surfaces 10A and 10B which are surfaces to be rolled (surfaces brought into contact with the hot rolling rolls) at least in the hot rolling process out of the outer surfaces of the rectangular cross-section titanium cast product 10 are molten by heating. In this respect, one surface 10A out of the two surfaces 10A and 10B shall be first subjected to the process. The surface layers are heated, for example, by being irradiated with an electron beam. Hereinafter, electron beam irradiation shall be explained as one example of a heating method.

In this regard, an area of a region 14 irradiated with an electron beam by one electron beam irradiation gun 12 on the surface 10A of the rectangular cross-section titanium cast product 10 is, as shown in FIG. 2, usually very small as compared with the whole area of the surface 10A to be irradiated. As a matter of fact, an electron beam is usually radiated while continuously moving the electron beam irradiation gun 12 or while continuously moving the rectangular cross-section titanium cast product 10. A shape and an area of the above irradiated region can be adjusted by regulating a focus of the electron beam or using an electromagnetic lens to oscillate a small beam at a high frequency to form a beam bundle. In the present embodiment, explanations are provided as follows, assuming that the electron beam irradiation gun 12 is continuously moved as shown by an arrow A in FIG. 2. A moving direction of the electron beam irradiation gun 12 shall not specifically be restricted, and usually the gun is continuously moved in a length direction (usually a casting direction D) or a width direction (usually a direction vertical to the casting direction D) of the rectangular cross-section titanium cast product 10 to continuously irradiate a width W (diameter W in the case of a circular beam or a beam bundle) of the irradiated region 14 described above in a belt form. Further, an unirradiated region adjacent to the irradiated region 14 is irradiated with an electron beam in a belt form while continuously moving the electron beam irradiation gun 12 to a reverse direction (or the same direction). In a certain case, plural irradiation guns may be used to irradiate plural regions with electron beams at the same time. In FIG. 2, a case in which a rectangular cross-section beam is continuously moved along a length direction (usually the casting direction D) of the rectangular cross-section titanium cast product 10 is shown. Also, when a beam passes on a part adjacent to a part once irradiated, ½ to ¼ of the part once irradiated is allowed to be irradiated once again, and the parts are treated so that a desired treatment depth can be achieved in all regions, whereby the effects of the present invention can sufficiently be exerted.

The surface (surface 10A) of the rectangular cross-section titanium cast product 10 is irradiated with an electron beam in the above first stage surface heat treatment process P1 to heat the surface to temperature of a melting point (usually about 1670° C.) or more of commercial pure titanium, whereby the surface layer of the surface 10A of the rectangular cross-section titanium cast product 10 is molten, as shown in a central left side of FIG. 3 (A), by a depth d1 corresponding to the heat input. That is, a region from the surface to a position of the depth d1 in a thickness direction is a molten layer (first stage molten layer 16). Also, in a region inner than the first stage molten layer 16 in the cast product, a part (heat affected layer=HAZ layer) heated to a temperature of a β transformation point or higher of pure titanium due to heat affection caused by irradiation with an electron beam is transformed into a β phase. As shown above, the region transformed into the β phase due to heat affection caused by irradiation with an electron beam in the first stage surface heat treatment process P1 is referred to as a first stage β transformation layer 18 in the present specification. A thickness of the above first stage β transformation layer 18 is set to d2.

In this regard, the depth d1+d2 of the first stage molten layer 16 and the β transformation layer 18 falls in a range of 6 mm to 20 mm in the first stage surface heat treatment process P1. The thickness d1 of the first stage molten layer 16 shall not specifically be restricted. The depth of d1+d2 can be controlled to be the depth described above, and usually d1 falls preferably in a range of 3 mm to 10 mm.

A heat input is related principally to a melting depth formed by irradiation with an electron beam, and therefore electron beam irradiation conditions are selected to control the heat input so that d1+d2 (6 mm to 20 mm) of the melting depth+the β transformation layer each described above are obtained. In fact, since the necessary heat input is varied depending on a thickness (heat capacity) of the cast product, a parent metal temperature and cooling conditions of a parent metal side, the heat input necessary for obtaining the melting thickness described above is not simply determined, and usually the heat input per unit area (per 1 $cm^2$) can be set to 80 to 300 J. In this regard, the electron beam irradiation conditions which affect the heat input per unit area include an output of the irradiation gun and a beam diameter, and a gun moving rate (irradiation position moving rate) when performing irradiation while continuously moving the irradiation gun as described above. The above conditions can suitably be set to secure the heat input described above.

If an electron beam is radiated while continuously moving the irradiation gun, the first stage molten layer 16 and the first stage β transformation layer 18 in a part which has been finished to be irradiated with an electron beam are cooled, as shown in the vicinity of the center in FIG. 3 (A), by removing heat to the parent metal (inside of the cast product 10), and when the layers reach a solidifying temperature or lower, they are solidified and turned into a resolidified layer (hereinafter referred to as a first stage molten and resolidified layer) 20. Also, the heat affected layer (first stage β transformation layer 18) at a lower side of the first stage molten layer formed by irradiation with an electron beam is heated to a temperature higher than the β transformation point and then cooed to a temperature lower than the β transformation point, whereby the heat affected layer is reversely transformed into an α phase. Coarse cast microstructure disappears and is turned into fine acicular microstructure (hereinafter referred to as a first stage HAZ layer) in the process in which the layer subjected to β transformation as described above is reversely transformed into an α phase. Thus, the layer which is reversely transformed into an α phase by cooling the first stage β transformation layer 18 is shown as a first stage HAZ layer 22 in FIG. 3. The above cooling process corresponds to the first stage cooling process P2. In the case of the present embodiment in which the surface of the rectangular cross-section titanium cast product 10 is irradiated with an electron beam while continuously moving the irradiation gun 12, while the first stage surface heat treatment process P1 proceeds by irradiating some portion on the plate surface 10A of the rectangular cross-section titanium cast product 10 with an electron beam, the first stage cooling process P2 for cooling the layer to a temperature lower than the β transformation point proceeds in an other portion (portion in which irradiation has already been finished).

Though not specifically illustrated, in irradiating the surface of the rectangular cross-section titanium cast product with an electron beam to perform the first stage surface heat treatment process P1 and then perform the first stage cooling process P2, the rectangular cross-section titanium cast product can be placed on a water cooled base composed of heat conductive material (metal) such as stainless steel, copper, aluminum and the like so that the rectangular cross-section titanium cast product is prevented from being wholly heated by irradiation with an electron beam. Immediately after the first stage surface heat treatment process P1 is performed, removing heat to a parent metal side is allowed to rapidly proceed so that the first stage cooling process P2 is performed. This makes it possible to further enhance the effects of the present invention.

In a process from the first stage surface heat treatment process P1 to the first stage cooling process P2, the surface (first stage molten layer 16) of the rectangular cross-section titanium cast product molten by irradiation with an electron beam is flattened by surface tension, and coarse undulations 10P on the cast surface are eliminated. Further, voids 10Q originating in casting which are present in an inside of the surface are eliminated as well by melting the surface (first stage molten layer 16). Accordingly, the first stage molten and resolidified layer 20 obtained by cooling and solidifying the first stage molten layer 16 is a layer having less undulations on a surface and less voids in an inside. Also, the coarse cast microstructure disappears by melting, and the fine acicular microstructure is formed by solidification in a subsequent cooling course and transformation from a β phase to an α phase. The above cooling and solidification are carried out by removing heat to a parent metal side, and a cooling rate by removing heat to the parent metal side is considerably large, so that the acicular microstructure after solidification and transformation is turned into fine microstructure.

Also, the first stage β transformation layer 18 is heated to a temperature higher than the β transformation point and then cooled at a large cooling rate by removing heat to a parent metal side, and it is reversely transformed into an α phase to be turned into the first stage HAZ layer 22. This allows the first stage HAZ layer 22 to be turned as well into a fine acicular microstructure.

However, the thickness of the first stage molten and resolidified layer 20+the first stage HAZ layer 22 is as relatively large as 6 mm or more, and therefore it should be noted that the cooling rate at the first stage cooling process P2 is smaller, as explained later, than the cooling rate at the second stage cooling process P4.

Melting to the melting depth (depth d1) at the first stage is a process carried out in order to eliminate defects such as voids and wrinkles (originating in casting) which are present in a position in a depth of some extent. Usually, levels of the defects can be estimated to some extent by visually observing the surface of the cast surface, and therefore a thickness of the first stage molten and resolidified layer 20 can be determined according to results obtained by visual observation.

In this regard, if the depth d1 of the molten layer (first stage molten layer 16) in the first stage surface heat treatment process P1 is smaller than 3 mm, voids originating in casting which are present in the vicinity of 3 mm to 10 mm from the surface of the cast product (rectangular cross-section titanium cast product 10) cannot be eliminated. As a result, the surface layer reforming effect is unsatisfactorily exerted, and surface flaws originating in the voids described above are likely to be formed on the hot rolled sheet. Also, defects such as voids and the like which are present in an inside of the surface layer of the cast product are reduced usually in a position of a depth exceeding 10 mm from the surface to such an extent that can be almost ignored. If the defects are present, the defects can be made harmless by pressing and being integrated in the hot rolling process. Accordingly, even if the depth d1 of the molten layer is increased to more than 10 mm, the reforming effect cannot be expected to be enhanced further more. On the other hand, for an increase in the melting depth exceeding 10 mm, it is necessary to delay processing speeds (irradiation gun moving rate) and enhance an electron beam output of the irradiation gun, and therefore a reduction in the processing efficiency and an increase in the cost are likely to be brought about. Accordingly, the melting depth (depth of the first stage molten layer) d1 in the first stage surface heat treatment process is set preferably to 3 mm to 10 mm. However, in the melting depth d1 and the depth d2 of the β transformation layer (the first stage β transformation layer 18) which is present in a lower part of d1, the fine acicular microstructure is formed in the first stage cooling process P2 by transformation from the β phase to the α phase, and therefore it is difficult in certain cases to clearly distinguish d1 from d2. On the other hand, the parent metal part 28 in a lower part than the depth d2 is composed of coarse microstructure (cast solidification microstructure) as cast, and therefore it can be distinguished. Assuming that the total thickness of d1+d2 is 6 mm to 20 mm, it has been found that a thickness of d1 is approximately 3 to 10 mm, and therefore the thickness of d1+d2 has been set to a range of 6 to 20 mm. A thickness of the first stage molten and resolidified layer 20 obtained by allowing the first stage molten layer 16 to be resolidified in the first stage cooling process P2 is substantially the same as the melting depth d1 of the first stage molten layer 16. Further, a thickness of the first stage HAZ layer obtained by allowing the first stage β transformation layer 18 to be cooled to the β transformation point or lower in the first stage cooling process P2 is substantially the same as the depth d2 of the first stage β transformation layer 18. Accordingly, the thicknesses of the first stage molten and resolidified layer 20 and the first stage HAZ layer 22 are set as well to d1 and d2 in this embodiment, and the total of d1 and d2 has been set to a range of 6 mm to 20 mm. Of course, in fact, the depths of the first stage molten layer 16 and the first stage β transformation layer 18 are a little different in certain cases from the thicknesses of the first stage molten and resolidified layer 20 and the first stage HAZ layer 22 depending on influences and solidification shrinkage of the undulations on the surface of the raw material cast product (rectangular cross-section titanium cast product 10) and influences brought about by elimination of the voids present in the surface layer, but a difference between them is only small, and they can be regarded as substantially the same. A lower limit of the first stage melting depth and the first stage HAZ layer depth d1+d2 is particularly preferably set to 8 mm or more and an upper limit is particularly preferably set to 16 mm or less, more preferably 13 mm or less even in the range described above.

[Second Stage Surface Heat Treatment Process P3] to [Second Stage Cooling Process P4]

The first stage molten and resolidified layer 20 and the first stage HAZ layer 22 are formed in a depth of 6 mm to 20 mm from the surface on the surface 10A out of the two wide surfaces which are the surfaces to be rolled in the rectangular cross-section titanium cast product 10 in the first stage surface heat treatment process P1 and the first stage cooling process P2 each described above. Then, the surface of the first stage molten and resolidified layer 20 is irradiated again, as shown in a central left side of FIG. 3 (B), with an electron beam in the second stage surface heat treatment process P3 to rapidly heat the surface layer of the first stage molten and resolidified layer 20. In the second stage surface heat treatment process P3, the surface of the rectangular cross-section slab is irradiated with an electron beam while continuously moving the irradiation gun relatively to the rectangular cross-section slab in a way similar to the first stage surface heat treatment process P1, whereby almost the whole surface of the surface 10A is reheated, and the reheated layer 24 is quenched by removing heat to a parent metal side and turned into a microstructural refinement layer 26.

In this regard, the surface 10A of the rectangular cross-section titanium cast product 10 is irradiated with an electron beam in the second stage surface heat treatment process P3 to reheat the surface 10A (surface of the first stage molten and resolidified layer 20) of the rectangular cross-section titanium cast product 10 so that a region (region of a thickness d3) of up to a position of a depth of 1 mm or more and less than 6 mm in a thickness direction from the outermost surface reaches the β transformation point or higher, whereby the β transformation occurs. In this respect, the region reheated to the β transformation point or higher is referred to as a reheated layer 24 in this embodiment. The reheated layer 24 is turned into the microstructural refinement layer 26 after being cooled.

As described above, when the heating is performed to the β transformation point or higher in a depth of 1 mm or more by irradiation with an electron beam, a thin layer (about 0.5 to 2 mm or less: region 24A) in the outermost surface is heated to a temperature of the melting point or higher, and the outermost surface layer is molten again in many cases. Melting of the outermost surface layer shall not bring about specific problems, and it is only necessary that the region up to the position of a depth of 1 mm or more and less than 6 mm in a thickness direction from the outermost surface is heated to the β transformation point or higher and turned into the reheated layer 24. It may be also possible that the outermost surface is not molten, the region of up to the position of a depth of 1 mm or more and less than 6 mm from the outermost surface is heated to the β transformation point or higher, and the whole part of the reheated layer 24 is turned into a β transformation layer. Accordingly, the reheated layer 24 formed in the second stage surface heat treatment process P3 includes a case in which the reheated layer 24 is composed of a molten layer (referred to as a second stage molten layer 24A in the present specification) and a β transformation layer 24B at a lower side of the molten layer and a case in which the reheated layer 24 is composed only of the β transformation layer 24B throughout the whole part of the thickness direction. A case in which the outermost surface layer of the reheated layer 24 is molten and turned into the second stage molten layer 24A is shown in the present embodiment.

A heat input of irradiation with an electron beam in the second stage surface heat treatment process P3 can be determined so that the region up to the position of a depth of 1 mm or more and less than 6 mm is heated to the β transformation point or higher. That is, the heat input can be controlled so that the thickness d3 of the reheated layer 24 is 1 mm or more and less than 6 mm.

In irradiation with an electron beam in the first stage surface heat treatment process P1, the heat input is controlled so that the total of the melting depth (accordingly a depth heated to the melting point or higher) d1 and the depth d2 of the HAZ layer d2 is set to 6 mm to 20 mm so as to control the melting depth d1 to be 3 mm to 10 mm. On the other hand, in irradiation with an electron in the second stage surface heat treatment process P3, the heat input is controlled so that the depth d3 heated to the β transformation point or higher is 1 mm or more and less than 6 mm. The β transformation point is a markedly lower temperature than the melting point, and the depth heated to the β transformation point or higher from the surface which is prescribed in the second stage surface heat treatment process P3 is smaller than the melting depth in the first stage surface heat treatment process P1. Accordingly, the heat input is controlled so that the heat input (per unit time and unit area) in irradiation with an electron beam in the second stage surface heat treatment process P3 is decreased as compared with the heat input in irradiation with an electron beam in the first stage surface heat treatment process P1. The specific means for controlling the heat input includes, for example, controlling an output of the irradiation gun to be a lower level than the first stage surface heat treatment process P1, increasing a beam diameter of the irradiation gun more than a level in the first stage surface heat treatment process P1, and raising a gun moving rate (irradiation position moving rate) more than a rate in the first stage surface heat treatment process P1. Any one of the above means can be applied, or two or more means can be applied in combination. The specific heat input in irradiation with an electron beam in the second stage surface heat treatment process P3 shall not specifically be restricted, and the heat input can be usually about 15 to 80 J per unit area (per 1 $cm^2$).

Also in the second stage surface heat treatment process P3, as is the case with the first stage surface heat treatment process P1, an electron beam is radiated while continuously moving the irradiation gun relatively to the cast product in order to treat almost all area of the surface 10A of the cast product (rectangular cross-section titanium cast product 10). In the above case, when a beam passes on a part adjacent to a part once irradiated, ½ to ¼ of the part once irradiated is allowed to be irradiated once again, and the parts are treated so that the desired treatment depth can be achieved in all regions, whereby the effects of the present invention can sufficiently be exerted. In the above case, the reheated layer 24 in the part in which irradiation is finished is quenched by removing heat to the parent metal (inside of the cast product). In this regard, in a case where the outermost surface layer of the reheated layer is molten and the second stage molten layer 24A is present, the second stage molten layer 24A is solidified by quenching, is further quenched to the β transformation point or lower, and turned into a second stage molten and resolidified layer 26A having α phase microstructure. Also, a second stage β transformation layer 24B is heated as well to a temperature of higher than a β transformation point and then quenched to a temperature lower than the β transformation point to be turned into a second stage HAZ layer 26B having α phase microstructure, and the whole of the above layers 26A and 26B constitutes a microstructural refinement layer 26 described later. Such the cooling process corresponds to the second stage cooling process P4.

Also in the second stage surface heat treatment process P3 to the second stage cooling process P4, the rectangular cross-section titanium cast product 10 can be placed, as is the case with the first stage surface heat treatment process P1 to the first stage cooling process P2, on a water cooled base composed of a metal (metal) having high heat conductivity so that the rectangular cross-section titanium cast product 10 is prevented from being wholly heated by irradiation with an electron beam, and heat removing to the parent metal side is allowed to quickly proceed in the second stage cooling process P4, whereby the effects of the present invention can be further enhanced.

Also, in the present embodiment in which the surface of the rectangular cross-section titanium cast product is irradiated with an electron beam while continuously moving the irradiation gun relatively to the rectangular cross-section titanium cast product in the second stage surface heat treatment process P3, while the second stage surface heat treatment process P3 proceeds, as is the case with the first stage surface heat treatment process P1 to the first stage cooling process P2, by irradiating a some portion on the surface of the rectangular cross-section titanium cast product with an electron beam, the second stage cooling process P4 proceeds in another portion (portion in which irradiation has already been finished).

In this regard, the heat input per unit time and unit area in irradiation with an electron beam in the second stage surface heat treatment process P3 is small as compared with the heat input in irradiation with an electron beam in the first stage surface heat treatment process P1, and therefore the cooling rate in the second stage cooling process P4 by removing heat to the parent metal side after irradiation with an electron beam is increased more than the cooling rate in the first stage cooling process P2. That is, a solidifying rate of the second stage molten layer 24A in the second stage cooling process P4 in a case where the surface of the reheated layer 24 is molten and turned into the second stage molten layer 24A is larger than a solidifying rate of the first stage molten layer 16 in the first stage cooling process P2, and the subsequent cooling rate in the second stage cooling process P4 is larger as well than the cooling rate of the first stage cooling process P2. Further, a cooling rate at which the second stage β transformation layer 24B is cooled to a temperature lower than the β transformation point in the second stage cooling process P4 is larger as well than a cooling rate of the first stage β transformation layer 24B in the first stage cooling process P2. Accordingly, the microstructure of the reheated layer 24 solidified and cooled in the second stage cooling process P4 is turned into sufficiently finer microstructure (fine acicular microstructure) than the microstructures (microstructures of the first stage molten and resolidified layer 20 and the first stage HAZ layer 22) cooled and solidified in the first stage cooling process P2. Thus, the layer obtained by refining the microstructure of the reheated layer 24 is referred to as the microstructural refinement layer 26.

Also, the first stage molten and resolidified layer 20 and the first stage HAZ layer 22 which are formed in the first stage surface heat treatment process P1 and the first stage cooling process P2 remain in an inside of the microstructural refinement layer 26. In this respect, the first stage molten and resolidified layer 20 and the first stage HAZ layer 22 remaining in an inside of the microstructural refinement layer 26 are turned into relatively coarse acicular microstructure as compared with the microstructure of the microstructural refinement layer 26. In the present invention, the first stage molten and resolidified layer 20 and the first stage HAZ layer 22 remaining in an inside of the microstructural refinement layer 26 are referred generically to as "an inside microstructural refinement layer". The term "relatively coarse" referred to herein means that "the first stage HAZ layer 22 is refined to less extent as compared with the microstructural refinement layer 26", and according to general standards, "the inside microstructural refinement layer" is composed as well of a fine acicular microstructure.

In this regard, if the depth d3 which is heated to the β transformation point or higher by irradiation with an electron beam in the second stage surface heat treatment process P3 is less than 3 mm, the microstructural refinement layer 26 is too thin, and therefore an effect of surely preventing flaws from being formed on the surface of the hot rolled sheet is not sufficiently obtained by microstructural refinement. On the other hand, if the depth d3 is 6 mm or more, the cooling rate by removing heat to the parent metal after irradiation with an electron beam is delayed, and satisfactory microstructural refinement is not necessarily sufficiently obtained. Accordingly, irradiation with an electron beam in the second stage surface heat treatment process P3 is controlled so that the depth d3 which is heated to the β transformation point or higher is 1 mm or more and less than 6 mm. That is, the reheated layer 24 heated to the β transformation point or higher shall be regarded to be in a position of 1 mm or more and less than 6 mm from the surface.

A lower limit of the depth (thickness of the reheated layer 24) d3 which is heated to the β transformation point or higher by irradiation with an electron beam in the second stage surface heat treatment process P3 is particularly set to 2 mm or more and an upper limit is set to 5 mm or less, preferably, even in the range of 1 mm or more and less than 6 mm described above.

Also, the second stage surface heat treatment may be carried out plural times, and it is important that in any heat treatment, a depth is set to be smaller than a depth in which the microstructure is reformed at least in the first stage surface heat treatment.

In this regard, an extent for quantitatively representing refinement of microstructure (acicular microstructure) in the microstructural refinement layer 26 obtained by cooling the reheated layer 24 in the second stage cooling process (including a case in which the process is carried out plural times) can be represented by a state in which heat treatment prior to hot rolling or equivalent one is carried out to recrystallize the microstructure instead of the state of the microstructure as it is. That is, it is only necessary that the number of crystal grains having a grain diameter of 3 mm or more is 5 or less per $m^2$ of the surface of the slab in a state in which the microstructure is turned into a fine recrystallized granular microstructure of a random orientation. That is, it is difficult to determine an extent of refining the acicular microstructure obtained by reheating and quenching, as it is. Accordingly, the grain diameter staying in a state of heat treatment prior to hot rolling or equivalent one is used in order to quantitatively represent the refinement of the microstructural refinement layer 26 obtained by reheating and quenching. The treatment equivalent to heat treatment prior to hot rolling means heat treatment at 820° C. for 240 minutes.

In a case where the number of crystal grains having a grain diameter of 3 mm or more exceeds 5 or more per $m^2$ of the surface of the slab in a state in which a microstructure (acicular microstructure) in the microstructural refinement layer 26 is recrystallized by carrying out the treatment equivalent to heat treatment prior to hot rolling, that is, a state in which the microstructure is turned into an equiaxed fine granular microstructure of a random orientation, the refinement is not considered to be achieved more notably than in a case where the second stage surface heat treatment process to the second stage cooling process are not carried out (that is, a case where a product of a slab for hot rolling is prepared in the first stage surface heat treatment process to the first stage cooling process), and it becomes difficult to surely and stably prevent relatively large dents and surface flaws on the hot rolled sheet from being formed in the beginning of hot rolling. In the microstructural refinement layer 26 after the heating prior to hot rolling or equivalent one, the number of crystal grains having a grain diameter of 3 mm or more is particularly preferably 1 or less even in the case of 5 or less per $m^2$ of the surface of the slab. The crystal grain diameters can surely be obtained by carrying out the second stage surface heat treatment process in which the region having a depth of 1 mm or more and less than 6 mm from the surface is heated to the β transformation point or higher.

The crystal grain diameter means a crystal grain diameter in a corresponding region of a cross section in a thickness direction of the slab. To be specific, the crystal grain diameter means a crystal grain diameter obtained by measuring the grain diameters of all crystal grains in a depth from the outer surfaces of the wide surfaces 10A, 10B (surfaces to be rolled) up to a depth including the whole of the corresponding region in a thickness direction of the slab, for example, in a cross section (cross section in thickness direction) vertical to a length direction (rolling direction D) of the slab and measuring the grain diameters throughout a prescribed distance in a width direction of the slab. In this connection, the grain diameters are measured preferably throughout a distance of about ½ of a width (half width) of the slab in order to obtain the grain diameters with a high reliability.

Further, in the second stage surface heat treatment process P3, at least one kind of α-phase stabilizing elements and neutral elements may be allowed to be present in the surface of the rectangular cross-section titanium cast product, and the α-phase stabilizing elements and the neutral elements may be molten together in melting the surface part of the rectangular cross-section titanium cast product to allow the α-phase stabilizing elements and the neutral elements to be present densely in the surface part. At least one kind of powders, chips, wires, thin films and swarfs can be used in combination as a material for the α-phase stabilizing elements and the neutral elements. The α-phase stabilizing elements and the neutral elements are preferably Al, Sn and Zr. Addition of these elements to titanium makes it possible to suppress the crystal grain growth in an α single phase region. Accordingly, the crystal grains can be maintained fine even when the α phase is heated to be a high temperature area in hot rolling. A concentration of more than a certain extent is necessary for suppressing the crystal grain growth. At least one kind of the α-phase stabilizing elements and the neutral elements is added preferably in an amount of 0% or more and less than 2% in terms of a total mass % in a range of a depth of 4 mm or less from the surface of the titanium cast product for hot rolling.

Also, in the second stage surface heat treatment process P3, at least one kind of β-phase stabilizing elements may be allowed to be present in the surface of the rectangular cross-section titanium cast product, and the β-phase stabilizing elements may be molten together in melting the surface part of the rectangular cross-section titanium cast product to allow the β-phase stabilizing elements to be present densely in the surface part. At least one kind of powders, chips, wires, thin films and swarfs can be used in combination as a material for the β-phase stabilizing elements. The β-phase stabilizing element includes V, Mo, Fe, Cr, Mn, Ta, Nb, Ni, Cr, Co, Cu, W and the like. However, in titanium, an element such as W having a high melting point is causative of HDI (high density inclusion) and becomes a starting point of fatigue failure when such element without being molten and sufficiently diffused remains in the titanium material, and therefore such element has to be carefully used. The β-phase stabilizing element can be classified into a complete solid solution type such as V, Mo, Ta, Nb and the like and a eutectoid type such as Fe, Cr, Mn, Co, Ni, Cu and the like. In the eutectoid type, each of the β-phase stabilizing elements has a small solid solubility but has a large β stability, and therefore the β-phase stabilizing elements of the eutectoid type are more effective even when being added in a smaller amount. The β-phase stabilizing element is contained in the surface of the rectangular cross-section titanium cast product by melting the β-phase stabilizing element together in the second stage surface heat treatment process P3. As a result, the hardenability is enhanced by adding the β-phase stabilizing elements, whereby the finer microstructure can be obtained. "Enhancement in the hardenability" referred to herein means that in the continuous-cooling transformation diagram (CCT-curve), a nose of transformation in cooling is shifted to a long time side by adding the β-phase stabilizing elements to the surface of the titanium cast product, whereby the cast product is transformed at low temperature. The transformation at low temperature makes it possible to increase the nucleation sites to increase and refine the crystal grains. The microstructure stays in a state of a two phase of α+β in heating in hot rolling, and a β phase is formed in a grain boundary of an α phase, whereby grain growth in the α phase are suppressed. Accordingly, a hot rolled titanium material having no surface flaws formed is produced due to that the crystal grains in hot rolling are maintained in a state of fine crystal grains. At least one kind of the β-phase stabilizing elements is included preferably in an amount of 1.5% or less in terms of total mass % in a range of a depth of 4 mm or less from the surface of the titanium cast product for hot rolling.

Alternatively, in the second stage surface heat treatment process P3, at least one kind of the α-phase stabilizing elements and the neutral elements and at least one kind of the β-phase stabilizing elements may be allowed to be present in the surface of the rectangular cross-section titanium cast product, and the α-phase stabilizing elements, the neutral elements and the β-phase stabilizing elements, α-phase stabilizing elements, and the neutral elements may be molten together in melting the surface part of the rectangular cross-section titanium cast product to allow the α-phase stabilizing elements, the neutral elements, and the β-phase stabilizing elements to be present densely in the surface part. In this case, at least one kind of the α-phase stabilizing elements and the neutral elements is included preferably in an amount of 0% or more and less than 2.0% in terms of total mass %, and at least one kind of the β-phase stabilizing elements is included preferably in an amount of 1.5% or less in terms of total mass % in a range of a depth of 4 mm or less from the surface of the titanium cast product for hot rolling.

When the second stage surface heat treatment is carried out plural times, the operation of allowing the α-phase stabilizing elements, the neutral elements, and the β-phase stabilizing elements to be present densely in the surface part is carried out preferably in the final heat treatment.

When the β-phase stabilizing element is added, recrystallization is not brought about by heat treatment at 820° C. for 240 minutes, and the microstructure stays in a state of an acicular microstructure in a certain case. In such case, it is difficult to measure accurately the crystal grain diameter. In general, however, acicular microstructure is finer than recrystallized structure, and therefore formation of surface flaws can be suppressed even after hot rolling.

One surface 10A out of the two wide surfaces 10A and 10B (surfaces to be rolled in hot rolling) of the rectangular cross-section titanium cast product 10 is subjected to the first stage surface heat treatment process, the first stage cooling process, the second stage surface heat treatment process, and the second stage cooling process in the manners described above, and then, for example, the rectangular cross-section titanium cast product 10 is inverted to subject the other surface 10B to the first stage surface heat treatment process, the first stage cooling process, the second stage surface heat treatment process, and the second stage cooling process in the same manners as described above. In some cases, after one surface 10A is subjected to the first stage surface heat treatment process to the first stage cooling process, the other surface 10B may be subjected to the first stage surface heat treatment process to the first stage cooling process, and then the respective surfaces 10A and 10B may be subjected to the second stage surface heat treatment process to the second stage cooling process in order.

In the embodiment described above, the two wide surfaces 10A and 10B (surfaces to be rolled in hot rolling, and chamfers 11 are included if present; refer to FIG. 2) are treated out of the four surfaces 10A to 10D in a casting direction D (direction in which the cast product is pulled out in DC slab casting). However, the narrow surfaces 10C and 10D (surfaces which are edge sides in hot rolling) (refer to FIG. 2) out of the four wide surfaces may be subjected as well to the same treatment as the treatment to which the two wide surfaces 10A and 10B are subjected.

That is, a slab of a hot rolling material is subjected to reduction in hot rolling, whereby at least a part of a surface at an edge side of the material goes around usually toward a sheet surface side of the hot rolled sheet. Accordingly, if a microstructure on the surface layer of the surface at the edge side of the rectangular cross-section cast product is coarse, or many defects are present, surface flaws such as dents are likely to be formed on the surface close to both ends in a width direction of the hot rolled sheet. With regard to this matter, subjecting the surface at the edge side of the rectangular cross-section cast product as well to the same reforming treatment as described above makes it possible to effectively prevent such the matter as described above from taking place.

When the two surfaces 10C and 10D at the edge sides are subjected as well to the first stage surface heat treatment process, the first stage cooling process, the second stage surface heat treatment process, and the second stage cooling process in the same manners as described above, the respective processes to which the two surfaces 10C and 10D at the edge sides are subjected may be carried out after the respective processes to which the two wide surfaces 10A and 10B are subjected are finished. Alternatively, the respective processes for the two surfaces 10C and 10D may be appropriately carried out between the respective processes for the two wide surfaces 10A and 10B.

Microstructure of a cross-section in the vicinity of a surface (for example, the vicinity of the sheet surface 10A) of the titanium cast product for hot rolling obtained by subjecting the titanium cast product for hot rolling obtained in the manner described above, that is, the rectangular cross-section titanium cast product to reforming treatment is shown schematically in FIG. 4. Further, microstructure in a state in which the above titanium cast product for hot rolling is subjected to heat treatment equivalent to the heating prior to hot rolling is shown schematically in FIG. 5. FIG. 6 is a cross-sectional observation photograph showing a refinement layer, an inside refinement layer and a cast solidification microstructure in a surface part of the titanium cast product for hot rolling corresponding to FIG. 4.

The titanium cast product 30 for hot rolling shown in FIG. 4 corresponds to a state (state shown at a right side of FIG. 3 (B)) after finishing the second stage cooling process. In the titanium cast product 30 for hot rolling, a parent metal part 28 (inner part of the slab than the first stage HAZ layer 22) is composed of a coarse microstructure (cast solidification microstructure) as cast, and a part closer to the surface side than the HAZ layer 22 has a microstructural refinement layer 26 composed of acicular microstructure in the outermost surface and an inside microstructural refinement layer 27 composed of an acicular microstructure in an inside of the microstructural refinement layer 26. As described above, the inside microstructural refinement layer 27 is composed of the first stage molten and resolidified layer 20 and the first stage HAZ layer 22 each remaining in an inside of the microstructural refinement layer 26 after carrying out the second stage surface heat treatment process P3 and the second stage cooling process P4.

FIG. 6 (photograph) shows a surface part of the titanium cast product for hot rolling which corresponds to a state (state shown at a right side of FIG. 3 (B)) after finishing the second stage cooling process. In this titanium cast product 30 for hot rolling, a parent metal 28 (part in an inner side of the slab than the inside microstructural refinement layer 27 (the first stage HAZ layer 22) is composed of coarse microstructure as cast. The surface of the titanium cast product 30 for hot rolling is composed of double layer fine acicular microstructure of the microstructural refinement layer 26 in the outermost surface and the inside microstructural refinement layer 27 in an inner part of the slab than the microstructural refinement layer 26. The inside microstructural refinement layer 27 can be observed in the form of two layers in a certain case depending on the conditions of the first stage surface heat treatment process P1 and the first stage cooling process P2. Also, the microstructural refinement layer 26 can be observed in the form of two layers in a certain case depending on the conditions of the second stage surface heat treatment process P3 and the second stage cooling process P4. Accordingly, the microstructural refinement layer 26 and the inside microstructural refinement layer 27 can be observed in the form of three layers or four layers in a certain case.

As shown in FIG. 5, when the fine acicular microstructure of the microstructural refinement layer 26 and the inside microstructural refinement layer 27 is recrystallized in a state in which the heat treatment equivalent to heating prior to hot rolling (at 820° C. for 240 minutes) has been carried out, particularly the microstructural refinement layer 26 (a second stage molten and resolidified layer 26A and a second stage HAZ layer 26B) at an outermost surface side of the slab is turned into marked fine recrystallization equiaxed microstructure in which the number of crystal grains having a grain diameter of 3 mm or more is 5 or less per $m^2$ of the slab surface. Also, the microstructure (inside microstructural refinement layer 27) of the first stage molten and resolidified layer 20 and the first stage HAZ layer 22 each present at an inner side of the slab than the microstructural refinement layer 26 is refined to less extent than the microstructural refinement layer 26. In the first stage molten and resolidified n layer 20, voids originating in casting are almost eliminated by melting in the first stage surface heat treatment process. Voids 10Q remain slightly in some parts, but an inside of the voids 10Q stays in vacuum, so that the voids are pressed and eliminated in hot rolling and turned into harmlessness in a hot rolled sheet product. Further, the outermost surface of the sheet surface 10A is turned into a relatively smooth surface by melting in the first stage surface heat treatment process.

The recrystallization temperature is varied depending on the kind and the concentration of impurities contained in the titanium slab, and the prior microstructure. In general, if the heating temperature prior to hot rolling is 700° C. or higher, the microstructure can be recrystallized during heating prior to hot rolling, but when the β-phase stabilizing element is added, a molten layer d4 at the second stage remains in the form of a fine acicular microstructure in a certain case without being recrystallized. However, the microstructures are very fine, and therefore defects that turns into flaws formed in the subsequent hot rolling stay in a level which makes no great difference as compared with a case in which the molten layer d4 is recrystallized.

In using actually the thus obtained titanium cast product for hot rolling, it is hot-rolled into a hot rolled sheet having a prescribed sheet thickness. The method of hot rolling shall not specifically be restricted, and when it is hot rolled into a thin hot-rolled sheet product, coil rolling is usually applied. Also, the sheet thickness after finishing hot rolling in the above case shall not specifically be restricted, and it is usually 3 mm to 8 mm. The hot rolling conditions shall not specifically be restricted, and the cast product is heated, as is the case with usual hot rolling, at 720 to 920° C. for 60 to 420 minutes to initiate hot rolling at temperature falling in the above range, and the hot rolling can be finished at a temperature of a room temperature or higher according to the capacity of the rolling mill.

The microstructural state of the cross section in the vicinity of the sheet surface 10A in the hot rolled sheet after hot rolling is substantially equivalent to the microstructure of a state in which the cast product is subjected to heat treatment equivalent to the heating prior to hot rolling shown in FIG. 5 excluding extension of the crystal grains in a rolling direction in the hot rolling. That is, in the microstructural refinement layer 26 and the inside microstructural refinement layer 27 which are refined by melting treatment before the hot rolling, the microstructure itself is worked and extended as well after the hot rolling, but the microstructure maintains a sufficiently refined state as compared with the part 28.

In the above embodiment, the rectangular cross-section titanium cast product obtained by EBR-DC slab casting is subjected to the respective processes as it is, that is, as a material for manufacturing a titanium cast product for hot rolling in the form of a material as cast without passing through a breakdown process carried out by hot working such as slab rolling and forging and passing through a cutting process for finishing a surface. That is, a material having a cast surface as cast (cast surface on which marked undulations originating in casting are present and which has casting defects such as many voids and the like on a surface part and includes a surface of a so-called black mill scale skin) is used. The effects of the present invention can most effectively be exerted when the present invention is applied to such the cast product as cast. However, the present invention is permitted as well to be applied in certain cases to a cast product in which a layer up to several mm from an outermost surface is subjected to cutting work and removed in order to remove undulations on a cast surface and voids close to the surface, that is, a cast product of a state in which a so-called descaled white skin appears. Further, the present invention is permitted as well to be applied to a cast product with so-called partially descaled white skin obtained by removing a part of an oxygen-enriched layer (maximum about 1 mm) by a cutting work, the oxygen-enriched layer being formed on a surface due to high temperature in taking out the cast product from a melting furnace and a cooling furnace opened after casting and exposing the cast product to air.

EXAMPLE(S)

The examples of the present invention shall be explained based on experiments of Test No. 1 to 38 shown in Table 1, Tables 2 (Table 2A and Table 2B), Tables 3 (Table 3A and Table 3B), Tables 4 (Table 4A and Table 4B), Tables 5 (Table 5A and Table 5B), Tables 6 (Table 6A and Table 6B), and Tables 7 (Table 3A and Table 7B) together with a reference example (=slab-rolled slab) according to the conventional methods and comparative examples (comparative examples in which the treatments of the present invention were not carried out at all and comparative examples in which treatments deviating from the conditions of the present invention were carried out).

[Test No. 1 to 3 (Table 1)]

Test No. 1 shown in Table 1 is a reference example carried out by a conventional method, wherein an electron beam molten cast product of pure titanium of JIS Class 1 having a cross section of a width of about 1300 mm×a thickness of about 400 mm and a length of about 7500 mm was hot rolled to be a cast product of a width of about 1210 mm and a thickness of about 260 mm by slab rolling, a long slab having a length of about 7000 mm was cut out, the whole surface of the slab was subjected to cutting work by about 5 mm, and a slab-rolled slab obtained by subjecting the slab to cutting work of chamfers having a width of 30 mm at an angle of 45 degrees between upper and lower surfaces and side surfaces was used. The dimensions of the slab are a width of about 1200 mm×a thickness of about 250 mm×a length of about 7000 mm.

Test No. 2 shown in Table 1 is a comparative example, wherein a pure titanium slab of JIS Class 1 having a cross section of a width of about 1220 mm×a thickness of about 270 mm and a length of about 7000 mm was obtained by DC casting by EBR, the whole surface of the slab was subjected to cutting work by about 10 mm, and a DC slab obtained by subjecting the above slab to cutting work of chamfers having a width of 30 mm at an angle of 45 degrees between upper and lower surfaces and side surfaces was used. The dimensions of the slab are a width of about 1200 mm×a thickness of about 250 mm×a length of about 7000 mm.

Test No. 3 shown in Table 1 is a comparative example, wherein a pure titanium slab of JIS Class 1 having a cross section of a width of about 1220 mm×a thickness of about 270 mm and a length of about 7000 mm was obtained by DC casting by EBR, the whole surface of the slab was not subjected to cutting work, and a DC slab obtained by subjecting the above slab to cutting work of chamfers having a width of 30 mm at an angle of 45 degrees between upper and lower surfaces and side surfaces was used. The dimension of the slab is the same as those of the cast product as DC cast.

The above slabs were inserted into a furnace at 820° C. and then heated for about 240 minutes to manufacture a hot rolled sheet coil having a thickness of 5 mm by a continuous hot rolling strip mill. The sheet coil was allowed to pass through a continuous pickling line containing nitric hydrofluoric acid to dissolve about 50 μm per one surface. Then, both sheet surfaces of the sheet coil were visually observed to measure the number of surface flaws. The number of the surface flaws generated in a frame of 1 meter square was measured in 10 to 15 fields to determine the average of the number of surface flaws. When the sheet length for observation does not reach 1 m, a surface area of the hot-rolled sheet observed was converted to be 1 $m^2$ to calculate the number of the surface flaws per $m^2$.

In this regard, in accordance with evaluation criteria for surface flaws on a hot rolled sheet, 0.3 or less surface flaws per $m^2$ were evaluated as passed, and 0.3 or more surface flaws per $m^2$ were evaluated as failure. The above evaluation criteria shall apply to the respective Test Nos. 4 to 38 described later.

As shown in Table 1, in a slab-rolled material of Test No. 1, the density of the flaws was lower than 0.3 per $m^2$ that is the passing point, and the surface stayed in a good condition. However, in the cases of both Test Nos. 2 and 3, many surface flaws were generated on the surfaces of the hot rolled sheets, and the sheets were evaluated as failure.

The good surface condition obtained in the slab-rolled material of Test No. 1 was obtained by passing through a process of slab rolling which takes labor, and it is not an effect exerted by the present invention.

[Test Nos. 4 to 15 (Table 2A and Table 2B)]

A DC slab of JIS Class 1 pure titanium having the same dimensions which was manufactured by passing through the same manufacturing processes as Test No. 3 was irradiated with an electron beam in a longitudinal direction by moving the slab and repeating a process for reciprocating the slab, whereby the whole surface to be rolled was irradiated with an electron beam. The side surfaces of the slab were irradiated as well with an electron beam.

Test No. 4 is a comparative example in which the slab was subjected only to the first stage surface heat treatment and in which the slab was not subjected to the second stage surface heat treatment. In Test Nos. 5 to 15, front surfaces of the slabs were subjected to the first stage surface heat treatment; then, the slabs were inverted, and rear surfaces were subjected to the first stage surface heat treatment. Subsequently, the slabs were inverted again, and the front surfaces were subjected to the second stage surface heat treatment. Thereafter, the slabs were inverted, and the rear surfaces were subjected to the second stage surface heat treatment. Then, the side surfaces of the slabs were irradiated as well with an electron beam in a similar manner. In this case, the irradiation conditions were varied in various manners. The electron beam was oscillated by using an electromagnetic lens to turn the electron beam into a rectangular cross-section form. Also, when the adjacent part was irradiated, the position of the electron beam was adjusted so that only ⅓ of the part molten previously by irradiation was molten again. A change in the temperature in cooling after irradiation with an electron beam was measured by an infrared thermometer to calculate the cooling rate in passing through the β transformation point.

The above slabs were inserted into a furnace to 820° C. and then heated for about 240 minutes to manufacture a hot rolled sheet coil having a thickness of 5 mm by a continuous hot rolling strip mill. The sheet coil was allowed to pass through a continuous pickling line containing nitric hydrofluoric acid to dissolve about 50 μm per one surface. Then, both sheet surfaces of the sheet coil were visually observed to measure the number of surface flaws.

All of Test Nos. 5, 6, 7, 8, 10, 11, 12 and 14 are the examples of the present invention and had, as shown in Table 2A and Table 2B, the form (at least double layer acicular microstructure) of the surface part prescribed in the present invention, and the examples presented the microstructure having the crystal grain diameter prescribed in the present invention after subjected to the heat treatment equivalent to heating prior to hot rolling; and the examples had less surface flaws after hot rolling and exceeded the passing line.

On the other hand, Test Nos. 4, 9, 13 and 15 are comparative examples in which the form of the surface part and the processing conditions each prescribed in the present invention were not satisfied, and they had, as shown in Table 2A and Table 2B, many surface flaws after hot rolling and the surface condition of the hot rolled sheets were evaluated as failure.

[Test Nos. 16 to 18 (Table 3A and Table 3B)]

A DC slab of JIS Class 1 pure titanium having the same dimensions which was manufactured by passing through the same manufacturing processes as Test No. 3 was irradiated with an electron beam by moving the slab and repeating a process for reciprocating the slab, whereby the whole surface to be rolled was irradiated with an electron beam. The side surfaces of the slab were irradiated as well with an electron beam.

Test Nos. 16, 17 and 18 are examples in which the direction and the order of irradiation were varied under the same processing conditions as in Test No. 5.

In Test No. 16, the slab was irradiated repeatedly in a width direction, and a front surface of a slab was subjected to the first stage surface heat treatment. Then the slab was inverted, and a rear surface was subjected to the first stage surface heat treatment. Further, the slab was inverted again, and the front surface was subjected to the second stage surface heat treatment. Thereafter, the slab was inverted, and the rear surface was subjected to the second stage surface heat treatment. Then, the side surfaces of the slab were irradiated as well with an electron beam in the same manner.

In Test No. 17, the slab was irradiated repeatedly in a longitudinal direction, and a front surface was subjected to the first stage surface heat treatment. Then, the same surface was subjected to the second stage surface heat treatment. Further, the slab was inverted, and a rear surface was subjected to the first stage surface heat treatment. Thereafter, the rear surface was subjected to the second stage surface heat treatment, and then the side surfaces of the slab were irradiated as well with an electron beam in the same manner.

In Test No. 18, the slab was irradiated repeatedly in a width direction, and a front surface was subjected to the first stage surface heat treatment. Then, the same surface was subjected to the second stage surface heat treatment. Further, the slab was inverted, and a rear surface was subjected to the first stage surface heat treatment. Thereafter, the rear surface was subjected to the second stage surface heat treatment, and then the side surfaces of the slab were irradiated as well with an electron beam in the same manner.

In the above electron beam irradiations, the electron beam was oscillated by using an electromagnetic lens to turn the electron beam into a rectangular cross-section form, and when the adjacent part was irradiated, the position of the electron beam was adjusted so that only ⅓ of the part molten previously by irradiation was molten again.

The above slabs were inserted into a furnace to 820° C. and then heated for about 240 minutes to manufacture a hot rolled sheet coil having a thickness of 5 mm by a continuous hot rolling strip mill. The sheet coil was allowed to pass through a continuous pickling line containing nitric hydrofluoric acid to dissolve about 50 μm per one surface. Then, both sheet surfaces of the sheet coil were visually observed to measure the number of surface flaws.

All of the above Test Nos. 16, 17 and 18 are the examples of the present invention and had, as shown in Table 3A and Table 3B, the form of the surface part prescribed in the present invention, and the examples presented the microstructure having the crystal grain diameter prescribed in the present invention after subjected to the heat treatment equivalent to heating prior to hot rolling. The examples had less surface flaws after hot rolling and exceeded the passing line.

[Test Nos. 19 to 23 (Table 4A and Table 4B)]

DC slabs of commercially pure titanium of various JIS Classes or ASTM Grades or modified pure titanium (low-alloyed titanium) that have the same dimensions which were manufactured by passing through the same manufacturing processes as in Test No. 3 were irradiated with an electron beam in a longitudinal direction by moving the slab and repeating a process for reciprocating the slab, whereby the whole surfaces to be rolled were irradiated with an electron beam. The side surfaces of the slabs were irradiated as well with an electron beam.

JIS Class 2 pure titanium was used in Test No. 19, JIS Class 3 pure titanium was used in Test No. 20, JIS Class 4 pure titanium was used in Test No. 21, a titanium alloy of ASTM Gr. 17 was used in Test No. 22, and a titanium alloy of ASTM Gr. 13 was used in Test No. 23. The titanium alloys to which alloy element was added were used in Test No. 22 and 23, but the addition amount of the alloy element was small, and the titanium alloys were modified pure titanium regarded as equivalent to pure titanium.

Front surfaces of the above slabs were subjected to the first stage surface heat treatment. Then, the slabs were inverted, and rear surfaces were subjected to the first stage surface heat treatment. Further, the slabs were inverted again, and the front surfaces were subjected to the second stage surface heat treatment. Thereafter, the slabs were inverted, and the rear surfaces were subjected to the second stage surface heat treatment. Then, side surfaces of the slabs were irradiated as well with an electron beam in the same manner. In this case, the irradiation conditions were varied in various manners. The electron beam was oscillated by using an electromagnetic lens to turn the electron beam into a circular form. Also, when the adjacent part was irradiated, the position of the electron beam was adjusted so that only ½ of the part molten previously by irradiation was molten again in the first stage surface heat treatment, and the position of the electron beam was adjusted so that only ¼ of the part molten previously by irradiation was molten again in the second stage surface heat treatment.

The above slabs were inserted into a furnace to 820° C. and then heated for about 240 minutes to manufacture a hot rolled sheet coil having a thickness of 5 mm by a continuous hot rolling strip mill. The sheet coil was allowed to pass through a continuous pickling line containing nitric hydrofluoric acid to dissolve about 50 μm per one surface. Then, both sheet surfaces of the sheet coil were visually observed to measure the number of surface flaws.

All of the above Test Nos. 19 to 23 are the examples of the present invention and had, as shown in Table 4A and Table 4B, the form of the surface part prescribed in the present invention, and the examples presented the microstructure having the crystal grain diameter prescribed in the present invention after subjected to the heat treatment equivalent to heating prior to hot rolling. The examples had less surface flaws after hot rolling and exceeded the passing line.

[Test Nos. 24 to 26 (Table 5A and Table 5B)]

A cast product obtained by subjecting JIS Class 1 pure titanium slab having a cross section of a width of 1000 mm×a thickness of 190 mm and a length of 5000 mm to DC casting by EBR was used in Test No. 24. A cast product obtained by subjecting JIS Class 1 pure titanium slab having a cross section of a width of 950 mm×a thickness of 165 mm and a length of 4500 mm to DC casting by EBR was used in Test No. 25. A cast product obtained by subjecting a slab having the same dimensions as in Test No. 24 to DC slab casting by plasma arc-melting was used in Test No. 26.

Front surfaces of the above slabs were subjected to the first stage surface heat treatment. Then, the slabs were inverted, and rear surfaces were subjected to the first stage surface heat treatment. Further, the slabs were inverted again, and the front surfaces were subjected to the second stage surface heat treatment. Thereafter, the slabs were inverted, and the rear surfaces were subjected to the second stage surface heat treatment. Then, side surfaces of the slabs were irradiated as well with an electron beam in the same manner. In this case, the irradiation conditions were varied in various manners. The electron beam was oscillated by using an electromagnetic lens to turn the electron beam into a rectangular cross-section form. Also, when the adjacent part was irradiated, the position of the electron beam was adjusted so that only ½ of the part molten previously by irradiation was molten again in the first stage surface heat treatment, and the position of the electron beam was adjusted so that only ⅓ of the part molten previously by irradiation was molten again in the second stage surface heat treatment.

The above slabs were inserted into a furnace to 820° C. and then heated for about 240 minutes to manufacture a hot rolled sheet coil having a thickness of 5 mm by a continuous hot rolling strip mill. The sheet coil was allowed to pass through a continuous pickling line containing nitric hydrofluoric acid to dissolve about 50 μm per one surface. Then, both sheet surfaces of the sheet coil were visually observed to measure the number of surface flaws.

The above slabs used in Test No. 24 to Test No. 26 have smaller dimensions than that of the slab used in Test No. 5, and therefore have a small heat capacity, so that cooling rates were decreased and grain diameters after the heat treatment equivalent to heating prior to hot rolling were increased. However, the slabs present microstructure having crystal grain diameters prescribed in the present invention, have less surface flaws after hot rolling, and exceeded the passing line.

[Test Nos. 27 to 34 (Table 6A and Table 6B)]

A DC slab of JIS Class 1 pure titanium having the same dimensions which was manufactured by passing through the same manufacturing processes as Test No. 3 was irradiated with an electron beam by moving the slab and repeating a process for reciprocating the slab, whereby the whole surface to be rolled was irradiated with an electron beam. The side surfaces of the slab were irradiated as well with an electron beam.

Front surfaces of the above slabs were subjected to the first stage surface heat treatment. Then, the slabs were inverted, and rear surfaces were subjected to the first stage surface heat treatment. Further, the slabs were inverted again, and Al powders were dispersed on the front surface of the slab in Test No. 27, Sn powders were dispersed on the front surface of the slab in Test No. 28, Fe powders were dispersed on the front surface of the slab in Test No. 29, Cr chips were dispersed on the front surface of the slab in Test No. 30, V chips were dispersed on the front surface of the slab in Test No. 31, and swarfs of a titanium alloy were dispersed on the front surfaces of the slabs in Test Nos. 32 to 34. Then, the front surfaces were subjected to the second stage surface heat treatment. Thereafter the slabs were inverted, and Fe powders were dispersed on the rear surfaces. Then, the rear surfaces were subjected to the second stage surface heat treatment. Then, side surfaces of the slabs were irradiated as well with an electron beam in the same manner. In this case, the irradiation conditions were varied in various manners. The electron beam was oscillated by using an electromagnetic lens to turn the electron beam into a circular form. Also, when the adjacent part was irradiated, the position of the electron beam was adjusted so that only ½ of the part molten previously by irradiation was molten again in the first stage surface heat treatment, and the position of the electron beam was adjusted so that only ¼ of the part molten previously by irradiation was molten again in the second stage surface heat treatment.

The above slabs were inserted into a furnace to 820° C. and then heated for about 240 minutes to manufacture a hot rolled sheet coil having a thickness of 5 mm by a continuous hot rolling strip mill. The sheet coil was allowed to pass through a continuous pickling line containing nitric hydrofluoric acid to dissolve about 50 μm per one surface. Then, both sheet surfaces of the sheet coil were visually observed to measure the number of surface flaws.

All of the above Test Nos. 27 to 34 are the examples of the present invention and had, as shown in Table 6A and Table 6B for the results for front surfaces, the form of the front surface part prescribed in the present invention, and the examples presented the microstructure having the crystal grain diameter prescribed in the present invention after subjected to the heat treatment equivalent to heating prior to hot rolling. The examples had less surface flaws after hot rolling and exceeded the passing line. In addition, rear surfaces of Test Nos. 27 to 34, on which Fe powders were dispersed, showed less surface flows around 0.02 per $m^2$ and exceeded the passing line.

[Test Nos. 35 to 38 (Table 7A and Table 7B)]

A DC slab of JIS Class 1 pure titanium having the same dimensions which was manufactured by passing through the same manufacturing processes as Test No. 3 was irradiated with an electron beam by moving the slab and repeating a process for reciprocating the slab, whereby the whole surface to be rolled was irradiated with an electron beam. The side surfaces of the slab were irradiated as well with an electron beam.

In Test No. 35, front surface of the above slab was subjected to the first stage surface heat treatment. Then, the slab was inverted, and rear surface was subjected to the first stage surface heat treatment. Further, the slab was inverted again, and the front surface was subjected to the second stage surface heat treatment. Thereafter, the slab was inverted, and the second stage surface heat treatment was performed. Further, the slab was inverted to disperse Fe powders on the front surface, and then the front surface was subjected to the third stage surface heat treatment. Thereafter, the slab was inverted to disperse Fe powders on the rear surface, and then the third stage surface heat treatment was performed. In Test Nos. 37 and 38, Al powders and Fe powders were dispersed on surfaces of the slabs before the third stage surface heat treatment, and the front and rear surfaces of the slabs were subjected to the surface heat treatment. Also, in Test No. 36, the slab was subjected to the surface heat treatment as was the case with Test No. 35. Then, the slab was inverted, and front and rear surfaces of the slab were subjected to the fourth stage surface heat treatment. Thereafter, side surfaces of the slab were irradiated as well with an electron beam in the same manner. In this case, the irradiation conditions were varied in various manners. The electron beam was oscillated by using an electromagnetic lens to turn the electron beam into a circular form. Also, when the adjacent part was irradiated, the position of the electron beam was adjusted so that only ½ of the part molten previously by irradiation was molten again in the first stage surface heat treatment, and the position of the electron beam was adjusted so that only ¼ of the part molten previously by irradiation was molten again in the second stage surface heat treatment.

The above slabs were inserted into a furnace to 820° C. and then heated for about 240 minutes to manufacture a hot rolled sheet coil having a thickness of 5 mm by a continuous hot rolling strip mill. The sheet coil was allowed to pass through a continuous pickling line containing nitric hydrofluoric acid to dissolve about 50 μm per one surface. Then, both sheet surfaces of the sheet coil were visually observed to measure the number of surface flaws.

All of the above Test Nos. 35 to 38 are the examples of the present invention and had, as shown in Table 7A and Table 7B, the form of the surface part prescribed in the present invention, and the examples presented the microstructure having the crystal grain diameter prescribed in the present invention after subjected to the heat treatment equivalent to heating prior to hot rolling. The examples had less surface flaws after hot rolling and exceeded the passing line.

TABLE 1

| Test No. | Flaw result after pickling hot rolled sheet(number of flaws per $m^2$) | Remarks |
|---|---|---|
| 1 | 0.15 | Reference Example (cutting one surface by 5 mm after slab-rolling, and hot rolling without EB irradiation) |
| 2 | 1.8 | Comparative Example (cutting one surface by 10 mm, and hot rolling without EB irradiation), DC slab |
| 3 | 3.5 | Comparative Example (no cutting, and hot rolling without EB irradiation in black mill scale skin state as cast), DC slab |

TABLE 2A

| | First stage surface heat treatment | | | | Second stage surface heat treatment | | | | |
|---|---|---|---|---|---|---|---|---|---|
| Test No. | Rectangular EB dimension (cm) | Output (kW) | Travelling rate (speed) (cm/s) | Heat input per $cm^2$ (J) | Rectangular EB dimension (cm) | Output (kW) | Travelling rate (speed) (cm/s) | Heat input per $cm^2$ (J) | Slowest cooling rate (° C./s) |
| 4 | 2.5 | 30 | 60 | 200 | — | — | — | — | — |
| 5 | 2.5 | 30 | 60 | 200 | 3 | 20 | 200 | 33 | 100 |
| 6 | 2.5 | 25 | 60 | 167 | 3 | 20 | 200 | 33 | 100 |
| 7 | 2 | 25 | 100 | 125 | 3 | 20 | 200 | 33 | 100 |
| 8 | 3 | 30 | 120 | 83 | 3 | 20 | 200 | 33 | 100 |
| 9 | 4 | 25 | 100 | 63 | 4 | 20 | 200 | 25 | 110 |
| 10 | 2 | 25 | 45 | 278 | 3 | 20 | 200 | 33 | 100 |
| 11 | 2 | 30 | 45 | 333 | 3 | 20 | 200 | 33 | 100 |
| 12 | 2.5 | 25 | 60 | 167 | 2.5 | 20 | 105 | 76 | 70 |
| 13 | 2.5 | 25 | 60 | 167 | 2.5 | 25 | 115 | 87 | 55 |
| 14 | 2.5 | 25 | 60 | 167 | 2.5 | 10 | 220 | 18 | 130 |
| 15 | 2.5 | 25 | 60 | 167 | 3 | 10 | 270 | 12 | 150 |

TABLE 2B

| Test No. | d1+ d2 (mm) | d3 (mm) | Grain diameter after heated at 820° C. for 240 minutes Number of grains, per $m^2$, the grains having grain diameter of 3 mm or more and being present within 4 mm from rolled surface | Result of flaw inspection after pickling hot rolled sheet (number of flaws per $m^2$) | Remarks |
|---|---|---|---|---|---|
| 4 | 12.3 | — | 10.1 | 0.73 | Comparative Example: heat input only in first stage |
| 5 | 12.2 | 3.9 | 0.8 | 0.1 | Example: basis |

TABLE 2B-continued

| Test No. | d1+ d2 (mm) | d3 (mm) | Grain diameter after heated at 820° C. for 240 minutes Number of grains, per $m^2$, the grains having grain diameter of 3 mm or more and being present within 4 mm from rolled surface | Result of flaw inspection after pickling hot rolled sheet (number of flaws per $m^2$) | Remarks |
|---|---|---|---|---|---|
| 6 | 11.1 | 3.9 | 0.7 | 0.1 | Example: basis |
| 7 | 8.4 | 3.9 | 0.8 | 0.1 | Example: basis |
| 8 | 6.6 | 3.9 | 0.8 | 0.25 | Example: a little low heat input in first stage. Good but tends to be increased in flaws |
| 9 | 5.5 | 3.5 | 0.8 | 0.33 | Comparative Example: too low heat input in first stage. Good microstructure but failure in flaw inspection due to voids in casting |
| 10 | 14.1 | 4 | 0.7 | 0.12 | Example: a little high heat input in first stage |
| 11 | 15.5 | 4 | 0.7 | 0.12 | Example: high heat input in first stage. Good but large energy cost |
| 12 | 11.9 | 5.8 | 2.2 | 0.25 | Example: a little high heat input in second stage. Good but tends to be increased in flaws |
| 13 | 11.9 | 6.8 | 6.2 | 0.52 | Comparative Example: too high heat input in second stage. Slow cooling rate, too large grain diameter, and failure in flaw inspection |
| 14 | 12 | 1.5 | 0.7 | 0.25 | Example: a little low heat input in second stage |
| 15 | 12.1 | 0.9 | 0.9 | 0.45 | Comparative Example: too low heat input in second stage. d3 not higher than lower limit value, good grain diameter, but failure in flaw inspection |

25

TABLE 3A

| | First stage surface heat treatment | | | | Second stage surface heat treatment | | | | |
|---|---|---|---|---|---|---|---|---|---|
| Test No. | Rectangular EB dimension (cm) | Output (kW) | Travelling rate (speed) (cm/s) | Heat input per $cm^2$ (J) | Rectangular EB dimension (cm) | Output (kW) | Travelling rate (speed) (cm/s) | Heat input per $cm^3$ (J) | Slowest cooling rate (° C./s) |
| 16 | 2.5 | 30 | 60 | 200 | 3 | 20 | 200 | 33 | 90 |
| 17 | 2.5 | 30 | 60 | 200 | 3 | 20 | 200 | 33 | 95 |
| 38 | 2.5 | 25 | 60 | 167 | 3 | 20 | 200 | 33 | 95 |

TABLE 3B

| Test No. | d1 + d2 (mm) | d3 (mm) | Grain diameter after heated at 820° C. for 240 minutes Number of grains per $m^2$, the grains having grain diameter of 3 mm or more and being present within 4 mm from rolled surface | Result of flaw inspection after pickling hot rolled sheet (number of flaws per $m^2$) | Remarks |
|---|---|---|---|---|---|
| 16 | 12.2 | 3.9 | 0.8 | 0.12 | Example: irradiation in sheet width direction (front-rear-front-rear) →based on Test No. 5 |
| 17 | 12.4 | 3.9 | 0.8 | 0.11 | Example: irradiation in sheet longitudinal direction (front-front-rear-rear) →based on Test No. 5 |
| 18 | 11.0 | 3.9 | 0.75 | 0.12 | Example; irradiation in sheet width direction (front-front-rear-rear) →based on Test No. 5 |

TABLE 4A

| | First stage surface heat treatment | | | | Second stage surface heat treatmeat | | | | |
|---|---|---|---|---|---|---|---|---|---|
| Test No. | Circular EB dimension (cm) | Output (kW) | Travelling rate (speed) (cm/s) | Heat input per $cm^2$ (J) | Circular EB dimension (cm) | Output (kW) | Travelling rate (speed) (cm/s) | Heat input per $cm^2$ (J) | Slowest cooling rate (° C./s) |
| 19 | 2.5 | 30 | 60 | 255 | 3 | 20 | 200 | 42 | 85 |
| 20 | 2.5 | 25 | 60 | 212 | 3 | 20 | 200 | 42 | 85 |

TABLE 4A-continued

| | First stage surface heat treatment | | | | Second stage surface heat treatmeat | | | | |
|---|---|---|---|---|---|---|---|---|---|
| Test No. | Circular EB dimension (cm) | Output (kW) | Travelling rate (speed) (cm/s) | Heat input per $cm^2$ (J) | Circular EB dimension (cm) | Output (kW) | Travelling rate (speed) (cm/s) | Heat input per $cm^2$ (J) | Slowest cooling rate (° C./s) |
| 21 | 2.5 | 30 | 60 | 255 | 3 | 20 | 200 | 42 | 85 |
| 22 | 2.5 | 25 | 60 | 212 | 3 | 20 | 200 | 42 | 85 |
| 23 | 2.5 | 30 | 60 | 255 | 3 | 20 | 200 | 42 | 85 |

TABLE 4B

| Test No. | d1 + d2 (mm) | d3 (mm) | Grain diameter after heated at 820° C. for 240 minutes Number of grains per $m^2$, the grains having grain diameter of 3 mm or more and being present within 4 mm from rolled surface | Result of flaw inspection after pickling hot rolled sheet (number of flaws per $m^2$) | Remarks |
|---|---|---|---|---|---|
| 19 | 12.4 | 3.9 | 0.8 | 0.12 | JIS Class 2 |
| 20 | 11.0 | 3.7 | 0.7 | 0.1 | JIS Class 3 |
| 21 | 12.1 | 3.9 | 0.5 | 0.11 | JIS Class 4 |
| 22 | 11.1 | 3.6 | 0.8 | 0.11 | Ti—0.06Pd (ASTM Gr. 17) |
| 23 | 12.3 | 3.9 | 0.5 | 0.09 | Ti—0.5Ni—0.05Ru (ASTM Gr. 13) |

TABLE 5A

| | First stage surface heat treatment | | | | Second stage surface heat treatment | | | | |
|---|---|---|---|---|---|---|---|---|---|
| Test No. | Rectangular EB dimension (cm) | Output (kW) | Travelling rate (speed) (cm/s) | Heat input per $cm^2$ (J) | Rectangular EB dimension (cm) | Output (kW) | Travelling rate (speed) (cm/s) | Heat input per $cm^2$ (J) | Slowest cooling rate (° C./s) |
| 24 | 2.5 | 30 | 60 | 255 | 3 | 20 | 200 | 33 | 80 |
| 25 | 2.5 | 25 | 60 | 212 | 3 | 20 | 200 | 33 | 65 |
| 26 | 2.5 | 30 | 60 | 255 | 3 | 20 | 200 | 33 | 100 |

TABLE 5B

| Test No. | d1 + d2 (mm) | d3 (mm) | Grain diameter after heated at 820° C. for 240 minutes Number of grains per $m^2$, the grains having grain diameter of 3 mm or more and being present within 4 mm from rolled surface | Result of flaw inspection after pickling hot rolled sheet (number of flaws per $m^2$) | Remarks |
|---|---|---|---|---|---|
| 24 | 12.5 | 4.1 | 2.6 | 0.12 | Example |
| 25 | 11.1 | 4.4 | 4.2 | 0.25 | Example |
| 26 | 12.7 | 3.9 | 2.8 | 0.18 | Example |

*All examples are based on Sample No. 5

TABLE 6A

| | First stage surface heat treatment | | | | Second stage surface heat treatment | | | | |
|---|---|---|---|---|---|---|---|---|---|
| Test No. | Circular EB dimension (cm) | Output (kW) | Travelling rate (speed) (cm/s) | Heat input per $cm^2$ (J) | Circular EB dimension (cm) | Output (kW) | Travelling rate (speed) (cm/s) | Heat input per $cm^2$ (J) | Slowest cooling rate (° C./s) |
| 27 | 2.5 | 30 | 60 | 200 | 3 | 20 | 200 | 33 | 90 |
| 28 | 2.5 | 30 | 60 | 200 | 3 | 20 | 200 | 33 | 95 |
| 29 | 2.5 | 30 | 60 | 200 | 3 | 20 | 200 | 33 | 95 |

TABLE 6A-continued

| | First stage surface heat treatment | | | | Second stage surface heat treatment | | | | |
|---|---|---|---|---|---|---|---|---|---|
| Test No. | Circular EB dimension (cm) | Output (kW) | Travelling rate (speed) (cm/s) | Heat input per $cm^2$ (J) | Circular EB dimension (cm) | Output (kW) | Travelling rate (speed) (cm/s) | Heat input per $cm^2$ (J) | Slowest cooling rate (° C./s) |
| 30 | 2.5 | 30 | 60 | 200 | 3 | 20 | 200 | 33 | 95 |
| 31 | 2.5 | 30 | 60 | 200 | 3 | 20 | 200 | 33 | 95 |
| 32 | 2.5 | 30 | 60 | 200 | 3 | 20 | 200 | 33 | 95 |
| 33 | 2.5 | 30 | 60 | 200 | 3 | 20 | 200 | 33 | 95 |
| 34 | 2.5 | 30 | 60 | 200 | 3 | 20 | 200 | 33 | 95 |

TABLE 6B

| | | | Depth of 4 mm or less from front surface corresponding to front surface to be rolled | | | | | |
|---|---|---|---|---|---|---|---|---|
| Test No. | d1 + d2 (mm) | d3 (mm) | Contained element | Content of α-phase stabilizing element and/or neutral element (mass %) | Content of β-phase stabilizing element (mass %) | Grain diameter after heated at 820° C. for 240 minutes Within 4 mm from front surface to be rolled | Result of flaw inspection for front surface after pickling hot rolled sheet (number of flaws per $m^2$) | Remarks |
| 27 | 12.2 | 3.9 | Al | 0.5 | — | 0.01 | 0.12 | Example |
| 28 | 12.4 | 4.1 | Sn | 0.3 | — | 0.03 | 0.05 | Example |
| 29 | 12.1 | 4.0 | Fe | — | 0.3 | 0.01 | 0.02 | Example |
| 30 | 12.3 | 4.1 | Cr | — | 0.5 | 0.02 | 0.05 | Example |
| 31 | 12.5 | 3.9 | V | — | 0.4 | 0.05 | 0.05 | Example |
| 32 | 12.3 | 3.9 | Al + V | 0.54 | 0.78 | 0.01 | 0.10 | Example |
| 33 | 12.1 | 4.3 | Al + Fe | 0.44 | 0.10 | 0.01 | 0.05 | Example |
| 34 | 12.1 | 4.2 | Al + Sn + V + Cr | 0.20 | 1.20 | 0.01 | 0.15 | Example |

*All examples are based on Sample No. 5.

TABLE 7A

| | First stage surface heat treatment | | | | Second stage surface heat treatment | | | | Third stage surface heat treatment | |
|---|---|---|---|---|---|---|---|---|---|---|
| Test No. | Circular EB dimension (cm) | Output (kW) | Travelling rate (speed) (cm/s) | Heat input per $cm^2$ (J) | Circular EB dimension (cm) | Output (kW) | Traveling rate (speed) (cm/s) | Heat input per $cm^2$ (J) | Circular EB dimension (cm) | Output (kW) |
| 35 | 2.5 | 30 | 60 | 255 | 2.5 | 25 | 1000 | 125 | 3 | 20 |
| 36 | 2 | 25 | 45 | 278 | 2.5 | 2.5 | 30 | 60 | 2.5 | 25 |
| 37 | 2.5 | 30 | 60 | 255 | 2.5 | 25 | 1000 | 125 | 3 | 20 |
| 38 | 2.5 | 30 | 60 | 255 | 2.5 | 25 | 1000 | 125 | 3 | 20 |

| | Third stage surface heat treatment | | | Fourth stage surface heat treament | | | | |
|---|---|---|---|---|---|---|---|---|
| Test No. | Travelling rate (speed) (cm/s) | Heat input per $cm^2$ (J) | Slowest cooling rate (° C./s) | Circular EB dimension (cm) | Output (kW) | Travelling rate (speed) (cm/s) | Heat input per $cm^2$ (J) | Slowest cooling rate (° C./s) |
| 35 | 200 | 33 | 80 | — | — | — | — | — |
| 36 | 1000 | 125 | — | 4 | 25 | 100 | 125 | 80 |
| 37 | 200 | 33 | 80 | — | — | — | — | — |
| 38 | 200 | 33 | 80 | — | — | — | — | — |

TABLE 7B

| Test No. | d1 + d2 (mm) | d3 (mm) | Depth of 4 mm or less from surface corresponding to surface to be rolled: Contained element | Content of α-phase stabilizing element and/or neutral element (mass %) | Content of β-phase stabilizing element (mass %) | Grain diameter after heated at 820° C. for 240 minutes: Number of grains per $m^2$, the grains having grain diameter of 3 mm or more and being present in d3 region (region 26) | Result of flaw inspection after pickling hot rolled sheet (number of flaws per $m^2$) | Remarks |
|---|---|---|---|---|---|---|---|---|
| 35 | 12.3 | 4.0 | — | — | — | 1.5 | 0.12 | Example |
| 36 | 14.0 | 4.5 | — | — | — | 2.1 | 0.18 | Example |
| 37 | 12.1 | 4.4 | Al | 0.4 | — | 0.01 | 0.05 | Example |
| 38 | 11.9 | 4.3 | Fe | — | 0.3 | 0.02 | 0.07 | Example |

*All examples are based on Sample No. 5.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

REFERENCE SIGNS LIST

10 rectangular cross-section titanium cast product
10A to 10D surfaces
12 electron beam irradiation gun
16 first stage molten layer
20 first stage molten and resolidified layer
24 reheated layer
26 microstructural refinement layer
30 cast product for manufacturing hot rolled titanium sheet
40 hot rolled sheet
P1 first stage surface heat treatment process
P2 first stage cooling process
P3 second stage surface heat treatment process
P4 second stage cooling process

The invention claimed is:

1. A titanium cast product for hot rolling composed of commercially pure titanium, the titanium cast product comprising:

a microstructural refinement layer having acicular microstructure on an outermost layer of a surface layer to be rolled; and an inside microstructural refinement layer having acicular microstructure provided in an inside of the microstructural refinement layer, wherein cast solidification microstructure is present more inward than the inside microstructural refinement layer, wherein the microstructural refinement layer has finer microstructure than the inside microstructural refinement layer, wherein the microstructural refinement layer is present in a range of a depth of 1 mm or more and less than 6 mm from the surface, and wherein the inside microstructural refinement layer is present in an inside of the microstructural refinement layer in a range of a depth of 3 mm or more and 20 mm or less from the surface.

2. The titanium cast product for hot rolling according to claim 1, comprising at least one kind of α-phase stabilizing elements and neutral elements in an amount of 0% or more and less than 2.0% in terms of total mass % in a range of a depth of 4 mm or less from the surface.

3. The titanium cast product for hot rolling according to claim 1, comprising at least one kind of β-phase stabilizing elements in an amount of 1.5% or less in terms of total mass % in a range of a depth of 4 mm or less from the surface.

4. The titanium cast product for hot rolling according to claim 1, comprising, in a range of a depth of 4 mm or less from the surface, at least one kind of α-phase stabilizing elements and neutral elements in an amount of 0% or more and less than 2.0% in terms of total mass %, and at least one kind of β-phase stabilizing elements in an amount of 1.5% or less in terms of total mass %.

5. The titanium cast product for hot rolling according to claim 1, wherein the number of crystal grains having a crystal grain diameter of 3 mm or more is 5 or less per $m^2$ of the surface in a state of room temperature after heat treatment at 820° C. for 240 minutes.

6. A method for manufacturing a titanium cast product for hot rolling, the method comprising:

a first stage surface heat treatment process of heating a surface of a cast product material composed of commercially pure titanium to be rolled in hot rolling to heat a region of a depth of 6 mm or more and 20 mm or less from the surface to a β transformation point or higher and to melt a range of a depth of 3 mm or more and 10 mm from the surface, and a first stage cooling process of cooling the cast product material to temperature lower than the β transformation point after the first stage surface heat treatment process; and a second stage surface heat treatment process of reheating the surface subjected to the first stage surface heat treatment process and the first stage cooling process to heat a region of a depth of 1 mm or more and less than 6 mm from the surface to the β transformation point or higher, and a second stage cooling process of cooling the cast product material to temperature lower than the β transformation point after the second stage surface heat treatment process.

7. The method for manufacturing a titanium cast product for hot rolling according to claim 6, wherein a heat input per unit area in the second stage surface heat treatment process is set to be lower than a heat input per unit area in the first stage surface heat treatment process.

8. The method for manufacturing a titanium cast product for hot rolling according to claim 6, wherein an electron beam is radiated while continuously moving an electron beam radiation gun in a direction parallel to the surface of the cast product material in the respective processes of the first stage surface heat treatment process and the second stage surface heat treatment process.

9. The method for manufacturing a titanium cast product for hot rolling according to claim 6, wherein the first stage cooling process and the second stage cooling process are carried out by removing heat to a parent metal side of the cast product material.

10. The method for manufacturing a titanium cast product for hot rolling according to claim 6, wherein the cast product material is allowed to pass through the (3 transformation point at a cooling rate of 60° C./minute or more in the second stage cooling process.

11. The method for manufacturing a titanium cast product for hot rolling according to claim 6, wherein the second stage surface heat treatment process and the second stage cooling process are carried out plural times.

12. The method for manufacturing a titanium cast product for hot rolling according to claim 6, wherein the surface is molten together with a material containing at least one kind of α-phase stabilizing elements and neutral elements in the first stage surface heat treatment process.

13. The method for manufacturing a titanium cast product for hot rolling according to claim 6, wherein the surface is molten together with a material containing at least one kind of β-phase stabilizing elements in the first stage surface heat treatment process.

14. The method for manufacturing a titanium cast product for hot rolling according to claim 6, wherein the surface is molten together with a material containing at least one kind of α-phase stabilizing elements and neutral elements and a material containing at least one kind of β-phase stabilizing elements in the first stage surface heat treatment process.

15. The method for manufacturing a titanium cast product for hot rolling according to claim 6, wherein the surface is molten in the second stage surface heat treatment process.

16. The method for manufacturing a titanium cast product for hot rolling according to claim 15, wherein the surface is molten together with a material containing at least one kind of α-phase stabilizing elements and neutral elements in the second stage surface heat treatment process.

17. The method for manufacturing a titanium cast product for hot rolling according to claim 15, wherein the surface is molten together with a material containing at least one kind of β-phase stabilizing elements in the second stage surface heat treatment process.

18. The method for manufacturing a titanium cast product for hot rolling according to claim 15, wherein the surface is molten together with a material containing at least one kind of α-phase stabilizing elements and neutral elements and a material containing at least one kind of β-phase stabilizing elements in the second stage surface heat treatment process.

19. The method for manufacturing a titanium cast product for hot rolling according to claim 6, wherein the cast product material is casted by a DC slab casting method.

20. The method for manufacturing a titanium cast product for hot rolling according to claim 6, wherein the cast product material is obtained by casting a molten metal obtained by an electron beam remelting method by a DC slab casting method.

* * * * *